US005746615A

United States Patent [19]

Ichikawa et al.

[11] Patent Number: 5,746,615

[45] Date of Patent: May 5, 1998

[54] LIGHTING DEVICE

[75] Inventors: Masaaki Ichikawa; Tomoyuki Ono; Nobumichi Nishihama; Masaaki Isoda, all of Osaka, Japan

[73] Assignee: Matsushita Electric Works, Ltd., Osaka, Japan

[21] Appl. No.: 672,025

[22] Filed: Jun. 26, 1996

[30] Foreign Application Priority Data

Jul. 17, 1995 [JP] Japan ..... 7-180047
Dec. 28, 1995 [JP] Japan ..... 7-341978

[51] Int. Cl.[6] ..... H01R 33/02

[52] U.S. Cl. ..... 439/227; 439/332

[58] Field of Search ..... 439/227, 332, 439/611

[56] References Cited

FOREIGN PATENT DOCUMENTS 61-103887 7/1986 Japan .

62-104384 7/1987 Japan ..... H01R 33/06

*Primary Examiner*—Khiem Nguyen
*Assistant Examiner*—Eugene G. Byrd
*Attorney, Agent, or Firm*—Sughrue, Mion, Zinn, Macpeak & Seas, PLLC

[57] ABSTRACT

A lighting device has a single end lamp in which a base is disposed at one end of a bulb, and a single end lamp socket into which the base is to be inserted and then twisted to be rotatively engaged with the socket. The lamp has a projection and a lamp pin both projected from a bottom of the base, the tip end of the projection being further projected from the bottom of the base than the tip end of the lamp pin. The socket has a recess into which the projection of the lamp is inserted and rotated by a predetermined angle, as well as a lamp pin insertion hole positioned outside of the recess and concentric with the recess, and having a substantially arcuate shape. A conductor plate which elastically makes contact with the lamp pin is disposed in the lamp pin insertion hole.

11 Claims, 26 Drawing Sheets

FIG. 5 PRIOR ART
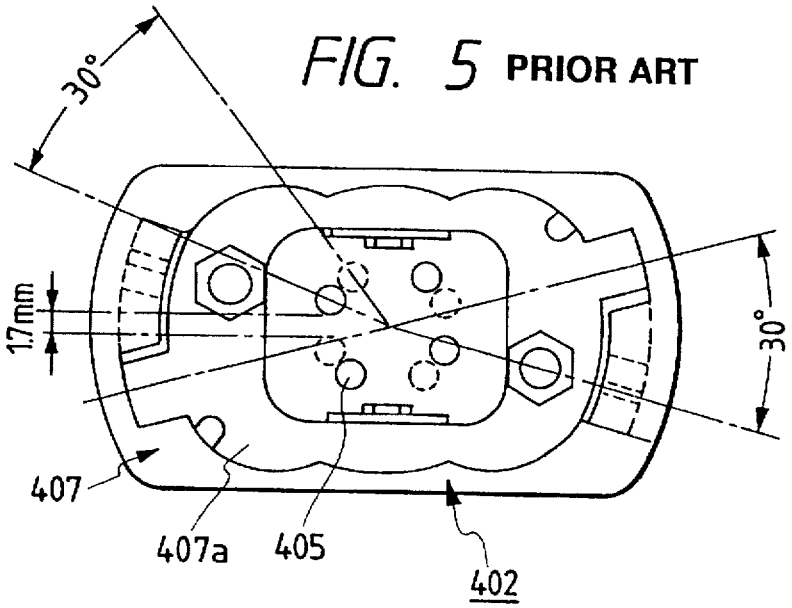
PRIOR ART
FIG. 6(a)
PRIOR ART
FIG. 6(b)
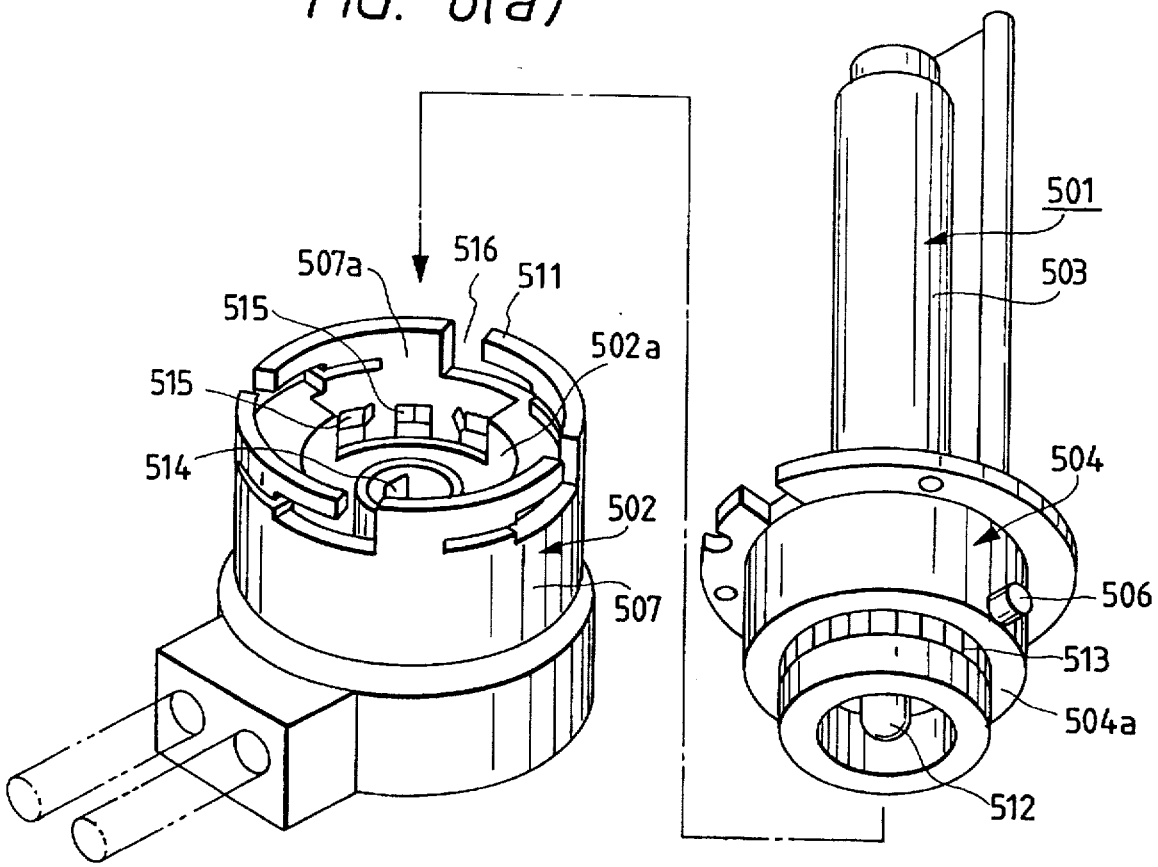

LIGHTING DEVICE

BACKGROUND OF THE INVENTION

1. Field of the invention

The invention relates to a socket for a single end lamp. Hereinafter, such a socket is referred to as "single end lamp socket.

2. Related art

FIGS. 1 to 5 show a single end lamp socket of the conventional art (first conventional art example). A single end lamp 401 is inserted into the single end lamp socket and then rotated to be engaged with the socket, thereby attaching the lamp to the socket. The single end lamp socket comprises the socket body 402 and contacts 403.

In the single end lamp 401 which is to be attached to the single end lamp socket, a bulb 404*b* is raised from the upper face 404*a* of a base 404 and four lamp pins 404*d* are erected from the lower face 404*c* in a direction opposite to the projection direction of the bulb 404*b*. Locking engaging portions 404*e* which are projected in a direction perpendicular to the projection direction of the bulb 404*b* are disposed on both sides of the side peripheral wall of the base 404, and erroneous attachment prevention grooves 404*f* are formed in the side wall of the base 404. The positions of the erroneous attachment prevention grooves are varied in accordance with the lamp rating.

The socket body 402 is made of a synthetic resin. A recess 402*a* which opens on the face to which the lamp is to be attached is formed in the socket body. Lamp pin insertion holes 402*c* are formed in the bottom 402*b* of the recess 402*a*. The contacts 403 which are urged by springs (not shown) toward the front face of the socket body 402 are housed in inner portions of the lamp pin insertion holes 402*c*. The recess 402*a* of the socket body 402 is configured so that the base 404 of the single end lamp 401 is rotatable in the recess about its center axis by a predetermined angle. Insertion grooves 402*d* which communicate with the recess 402*a* are formed in the peripheral wall of the recess 402*a*. When the locking engaging portions 404*e* of the single end lamp 401 are inserted from the lamp attaching face into the insertion grooves 402*d*, the locking engaging portions are rotatable. The front faces of the insertion grooves 402*d* which are on the side where the rotation of the lamp in the attaching operation is terminated function as engaging portions 402*e* which abut against the locking projections 404*e* so as to prevent the single end lamp 401 from slipping off. Erroneous attachment prevention projections 402*f* which are projected toward the inner space of the recess 402*a* are formed on the side wall of the recess 402*a*. Therefore, the erroneous attachment prevention grooves 404*f* of the single end lamp 401 have a width which, when the base 404 is rotated, allows the groove faces to avoid collision with the erroneous attachment prevention projections 402*f* which are relatively rotated.

The base 404 of the single end lamp 401 of this type, and the contact of the single end lamp socket 402 are specified in GX10q-1A to 7A and GY10q-1A to 7A of JIS C7709 (IEC publication 61). As shown in FIG. 5, the rotation range of these components during attaching and detaching operations is set to be 30°. The single end lamp socket 402 has contacts 403 which abut against the lamp pins 404*d* at all times including the lamp insertion period and the lamp rotation period. Thus, it is necessary to ensure an insulation distance. However, since the rotation range is restrictively determined in 30°, a distance of 1.7 mm is maintained at the maximum between the position of any one of the lamp pins 404*d* which are inserted into the single end lamp socket 402, and a virtual position where, when the single end lamp 401 is rotated by 30°, a lamp pin which is opposite in polarity and closest to the one lamp pin is situated.

In the lighting device, the single end lamp 401 is attached to the single end lamp socket 402 in the following manner. First, the base 404 is inserted from the lamp attaching face with aligning the base with the recess 402*a* of the single end lamp socket 402. The lamp pins 404*d* are inserted into the lamp pin insertion holes 402*c* so as to abut against the contacts 403, thereby pressing in the springs. Then, under this state, the single end lamp 401 is rotated by a predetermined angle. The springs urge the lamp pins 404*d* toward the bulb. This causes the locking projections 404*e* to abut against the engaging portions 402*e* so that the single end lamp 401 is held by the single end lamp socket 402. At this time, the lamp pins 404*d* maintain the state where they abut against the contacts 403 urged by the springs, thereby attaining the electrical connection therebetween.

FIGS. 6(*a*) and 6(*b*) show the main portions of a lighting device of the conventional art (second conventional art example). The lighting device is used as a head lamp of an automobile and comprises a lamp 501 and a lamp socket 502.

In the lamp 501, a base 504 is disposed at one end of a tubular bulb 503. The base 504 comprises a pin-like center electrode 512 which elongates along the center axis of the bulb 503 and is projected from the bottom 504*a* in a direction opposite to the bulb 503, and an annular outer electrode 513 disposed on an outer periphery of a cylindrical portion which is projected so as to surround the center electrode 512. Engaging projections 506 which are projected in a direction perpendicular to the projection direction of the bulb 503 are disposed on both sides of the peripheral wall which elongates between the bottom 504*a* and the bulb 503.

The lamp socket 502 comprises: the socket body 507 having a recess 507*a* which opens on a lamp attaching face 502*a* to which the lamp 501 is to be attached; a center contact 514 which is disposed on the bottom of the recess 507*a* of the socket body 507 and cramps the center electrode 512; and an outer contact 515 which is disposed on the peripheral wall of the recess 507*a* and abuts against the outer electrode 513. Cutaway portions 516 which elongate in the rotation direction of the lamp 501 so as to form an L-like shape are disposed at positions corresponding to the engaging projections 506 of the lamp 501. The piece positioned on the side of the front face of each of the cutaway portions 516 functions as an engaging portion 511. The lamp 501 is attached to the lamp socket 502 in a substantially same manner as the first conventional art example.

FIG. 7 shows the main portions of a lighting device of the conventional art (third conventional art example). The lighting device comprises a single end lamp 601 which is a lamp, and a single end lamp socket 602 which is a lamp socket.

The single end lamp 601 is formed by alternatingly communicating six tubular members arrange in substantially parallel, with each other at one ends and the other ends so that the inner spaces of the tubular members configure one continuous space. A single base 604 is disposed in the opening portion of a bulb 603 where only the two ends of the continuous space are opened. In the base 604, a square column-like projection 617 which is projected in a direction opposite to the projection direction of the bulb 603 is formed at a substantially center portion of the bottom 604*a* which is one end of the base. Two lamp pins 605 are erected from each of two areas of the bottom 604*a* which are respectively on both sides of the projection 617, so as to oppose the other lamp pins across the projection 617. The tip end of the projection 617 is further projected than the tip ends of the lamp pins 605. Engaging projections 606 which are projected in a direction substantially perpendicular to the center axis of the projection 617 are disposed on the side faces of the side peripheral wall of the projection 617. The base 604 is provided with erroneous attachment prevention ribs 618 projected at portions which are varied in accordance with the output rating of the lamp.

The single end lamp socket 602 comprises: the socket body 607 having a recess 607*a* which opens on a lamp attaching face 602*a* to which the lamp is to be attached; conductor plates which are housed in lamp pin insertion holes 607*b* and abut against the lamp pins 605, the lamp pin insertion holes 607*b* being formed in the lamp attaching face 602*a* and at positions outside the recess 607*a* of the socket body 607; and a protection wall 619 which stands on the outer periphery of the lamp attaching face 602*a* so as to substantially cover the base 604 of the attached single end lamp 601. The recess 607*a* defines a substantially rectangular parallelepiped space into which the projection 617 of the single end lamp 601 can be inserted. Insertion grooves 607*c* which communicate with the space and into which the engaging projections 606 disposed on the projection 617 are to be inserted are formed on both sides of the recess which are perpendicular to the sides where the lamp pin insertion holes 607*b* are formed. Engaging springs 620 are disposed in the insertion grooves 607*c*. The engaging springs 620 are laterally projected into the recess 607*a* so as to be engaged with the engaging projections 606 formed on the projection 617 of the single end lamp 601, thereby engaging with the single end lamp 601. The protection wall 619 is cut away at positions corresponding to the erroneous attachment prevention ribs 618 formed on the single end lamp 601, so as to form receiving portions 619*a*.

In the thus configured lighting device, the single end lamp 601 is attached to the single end lamp socket 602 in the following manner. The single end lamp 601 are inserted in a direction perpendicular to the lamp attaching face 602*a* into the single end lamp socket 602 with aligning the erroneous attachment prevention ribs 618 with the receiving portions 619*a*. This causes the projection 617 to be inserted into the recess 607*a*, and the lamp pins 605 to be inserted into the lamp pin insertion holes 607*b* so as to abut against the conductor plates. The engaging projections 606 disposed on the projection 617 are engaged with the engaging springs 620, thereby attaining the attachment of the single end lamp.

The single end lamp 601 may have another configuration as specified in G24d-1 to 3 of JIS C7709 (IEC publication) in which two lamp pins 605 are erected from the bottom 604*a*. Also in this case, the single end lamp socket 602 is configured in a substantially same manner as that described above.

However, the lighting device of the first conventional art example configured as described above has the following problems. The single end lamp 401 is inserted into the single end lamp socket 402 and then rotatively engaged therewith. The single end lamp socket 402 is suitable for attaching a lamp in which only the lamp pins 404*d* are projected from the bottom 404*c* of the single end lamp 401, but not suitable for a lamp having the projection 617 which is projected from the bottom 404*c* of the base 404 in the same direction as the lamp pins 404*d*.

In the thus configured single end lamp socket of the first conventional art example, furthermore, the erroneous attachment prevention grooves 404*f* must be formed in the base 404 of the single end lamp 401 so that, when the single end lamp 401 is rotated, collision with the erroneous attachment prevention projections 402*f* disposed on the socket body 402 is avoided. This causes the width of the erroneous attachment prevention grooves 404*f* in the rotation direction of the base 404, to be larger than that of the erroneous attachment prevention projections 402*f*. In order to surely prevent erroneous attachment from occurring, therefore, kinds of combinations of a single end lamp socket and the single end lamp 401 cannot be largely increased in number, thereby producing a problem in that such a single end lamp socket hardly copes with an increased number of ratings of the single end lamp 401.

Also in the lighting device of the second conventional art example, the lamp 501 is inserted into the lamp socket 502 and then rotatively engaged therewith. In the same manner as the first conventional art example, however, the socket is not suitable for a lamp having a projection which is projected from the bottom 504*a* of the base 504 in the same direction as the center electrode 512.

In the lighting device of the third conventional art example, the single end lamp 601 is inserted into the single end lamp socket 602 and then engaged therewith by the resiliency of the engaging springs 620. In other words, under the state where the single end lamp 601 is inserted into the single end lamp socket 602, the single end lamp 601 is cramped by the engaging springs 620, from both sides and only at the engaging projections 606 disposed on the projection 617. When an external force is applied to the engaging springs 620, therefore, the single end lamp 601 easily slips off from the socket, thereby producing a problem in that an impact or vibrations during use may cause the single end lamp 601 to fall off the socket.

SUMMARY OF THE INVENTION

The invention has been conducted in view of the problems. It is an object of the invention to provide a lighting device in which a lamp having a projection which is projected from the bottom of a base in the same direction as a lamp pin can be attached to a socket and the lamp hardly slips off by accident.

The invention has been conducted in view of the problems. It is an object of the invention to provide a single end lamp socket to which a single end lamp is to be rotatively attached and in which the area in the rotation direction that is required for erroneous attachment prevention in a proper combination of a single end lamp and the socket is reduced so that the socket easily copes with erroneous attachment prevention even when kinds of single end lamps are increased in number.

In order to solve the problems, according to the present invention, a lighting device comprises a single end lamp in which a base is disposed at one end of a bulb, and a single end lamp socket into which the single end lamp is to be inserted from the base and then twisted to be rotatively engaged with the socket, and is characterized in that the single end lamp comprises: a projection projected from a bottom of the base in a direction which is substantially parallel to a center axis substantially perpendicular to the bottom and which is opposite to a projection direction of the bulb, the bottom being substantially perpendicular to the projection direction of the bulb; and at least one lamp pin which is disposed on the bottom and which elongates in the same direction as the projection, the lamp pin extending toward the tip end of the projection such that the tip end of the lamp pin does not exceed the tip end of the projection, and, in the single end lamp socket, a recess into which the projection of the single end lamp is to be inserted and rotatable by a predetermined angle is formed in a lamp attaching face, a lamp pin insertion hole into which the lamp pin is to be inserted is formed and on a circumference which is outside the recess and concentric with the recess, the lamp pin insertion hole having a substantially arcuate shape, and a conductor plate which elastically makes contact with the lamp pin is disposed in the lamp pin insertion hole.

According to the present invention, in the lighting device, a erroneous attachment prevention lib is projected from the base of the single end lamp at a position which is varied in accordance with the output rating of the lamp, and a protection wall which opposes a peripheral wall of the base is disposed in an outer periphery of the lamp attaching face of the single end lamp socket, the protection wall selectively abutting against the erroneous attachment prevention lib to prevent an unsuitable single end lamp from being attached to the socket.

According to the present invention, in the lighting device, the projection of the single end lamp is formed into a square column-like shape, the number of the lamp pins is four, and two lamp pins are erected from each of two areas of the bottom which are respectively on both sides of the projection of the single end lamp, so as to oppose the other lamp pins across the projection.

According to the present invention, in the lighting device, the four lamp pins are on the bottom 4*a* and respectively disposed at vertexes of a virtual rectangle which has short sides of about 8 mm and long sides of about 23 mm, and, when the single end lamp is operated to be attached to or detached from the single end lamp socket, the rotation angle of the single end lamp is not smaller than 17° and not larger than 23°.

According to the present invention, in the lighting device, the single end lamp is urged in a direction from the base to the bulb under a state where the single end lamp is attached to the single end lamp socket.

According to the present invention, in the lighting device, an engaging projection is laterally projected from a side face of the projection of the single end lamp, and an engaging portion is disposed on a side wall of the recess of the single end lamp socket, the engaging portion abutting against the engaging projection from the side of the bulb when the single end lamp is rotated, thereby preventing the lump from slipping off in the direction to the bulb.

According to the present invention, in the lighting device, the engaging projection has an inclined face which has a predetermined angle with respect to a center axis of the projection so that a degree of the lateral projection from the projection is increased as moving from the bottom of the base toward the tip end of the projection, and an abutting face which has an inclination corresponding to the inclined face is formed in a portion of the engaging portion, the portion abutting against the inclined face.

According to the present invention, in the lighting device, the conductor plate has cramping pieces which cramp the lamp pin in the rotation direction and a vertical direction, and the cramping pieces are movable by a distance which is not shorter than a distance by which the lamp pin is movable in the rotation direction and the vertical direction.

According to the present invention, a single end lamp socket comprises: a socket body into which a single end lamp is to be inserted and then twisted, thereby rotatively engaging the single end lamp with the socket body, the single end lamp having a base in which a bulb is projected from an upper face and a plurality of lamp pins are projected from a lower face in a direction opposite to the bulb, a projection is disposed at a portion which is on the lower face of the base and a substantially center with respect to the lamp pins, a lock engaging portion being projected from a side wall of the projection, a tip end of the projection being further projected than the tip ends of the lamp pins, and an identification projection is disposed on a peripheral side face of the base at a position which is varied in accordance with an output rating; and a plurality of contacts which are housed in the socket body and abut against the lamp pins, thereby attaining an electrical connection, wherein a housing recess in which the projection is to be housed, and lamp pin insertion holes facing the contacts are formed in the socket body, and a rotor is disposed rotatably with respect to the socket body on the side of the socket body to which the single end lamp is to be attached, the rotor having a partition wall which substantially opposes a peripheral side wall of the base, a receiving groove into which the identification projection is to be inserted being formed in the partition wall.

According to the present invention, in the single end lamp socket, a base abutting face which, when the single end lamp is attached, substantially abuts against a lower face of the base is disposed inside the partition wall of the rotor and integrally with the partition wall, and small holes through which the lamp pins 104*d* are to be inserted are formed in portions of the base abutting face which oppose the lamp pin insertion holes.

According to the present invention, in the single end lamp socket, the base abutting face which, when the single end lamp is attached, substantially abuts against a lower face of the base is formed integrally with the socket body.

According to the present invention, in the single end lamp socket, attachment sensation generating means for, when attachment of the single end lamp is completed, generating attachment sensation indicative completion of attachment of the single end lamp, as a result of rotation of the rotor is disposed between the socket body and the rotor.

BRIEF DESCRIPTION OF THE DRAWINGS

FIG. 2(*b*) is a bottom view of the base;

FIG. 2(*c*) is a side view of the base;

FIG. 5 is a plan view showing the main portions of the base;

FIGS. 6(*a*) and 6(*b*) show the main portions of a lighting device of a second conventional art, FIG. 6(*a*) is a perspective view of a socket, and FIG. 6(*b*) is a perspective view of a lamp as seen at a different angle;

FIGS. 19 (*b*) is a side view of the relationship between the pitch variation of the lamp pins and clearances;

FIG. 22 (*b*) is a plan view of a contact of the present invention;

FIG. 22 (*c*) is a side view of the contact of the present invention;

DETAILED DESCRIPTION OF THE PREFERRED EMBODIMENTS

First embodiment

FIGS. 8 to 13 show a first embodiment of the lighting device of the invention. The lighting device includes a single end lamp 1 and a single end lamp socket 2.

Figure 8:
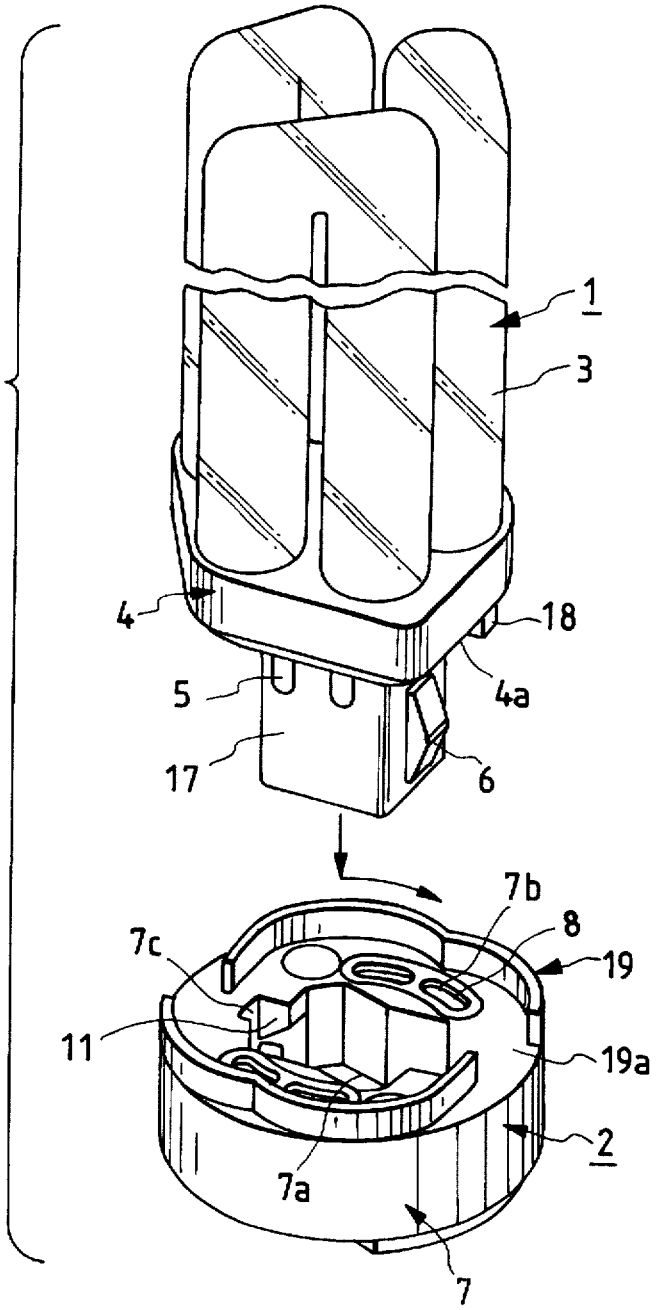
FIG. 8 is a perspective view showing the main portions of a first embodiment of the lighting device of the invention.

As shown in FIG. 8, the single end lamp 1 includes a bulb 3 which is formed by alternatingly communicating six tubular members arranged in substantially parallel, with each other at one ends and the other ends so that the inner spaces of the tubular members configure one continuous space having a length corresponding to the sum of the lengths of the six tubular members, and only the two ends of the continuous space are opened. Filaments are disposed in the openings of the bulb 3. A single base 4 is disposed so as to close the openings. The base 4 includes at one end the bottom 4*a* having a face which is substantially perpendicular to the projection direction of the bulb 3. A square column-like projection 17 which is projected in a direction substantially parallel to the center axis of the bottom 4*a* and opposite to the projection direction of the bulb 3 is formed at a substantially center portion of the bottom 4*a*. Two lamp pins 5 are erected from each of two areas of the bottom 4*a* which are respectively on both sides of the projection 17, so as to oppose the other lamp pins across the projection 17. The tip end of the projection 17 is further projected than the tip ends of the lamp pins 5. Engaging projections 6 which are projected in a direction perpendicular to the center axis of the projection 17 are disposed on the side faces of the side peripheral wall of the projection 17 where the lamp pins 5 are not disposed. The base 4 is provided with erroneous attachment prevention ribs 18 projected at portions which are varied in accordance with the output rating of the lamp.

The base 4 of the single end lamp 1, and the contact of the single end lamp socket 2 are specified as G24q-1, G24q-2, and G24q-3 in IEC 61 (IEC Publication 61-1 7004-78).

Figure 9:
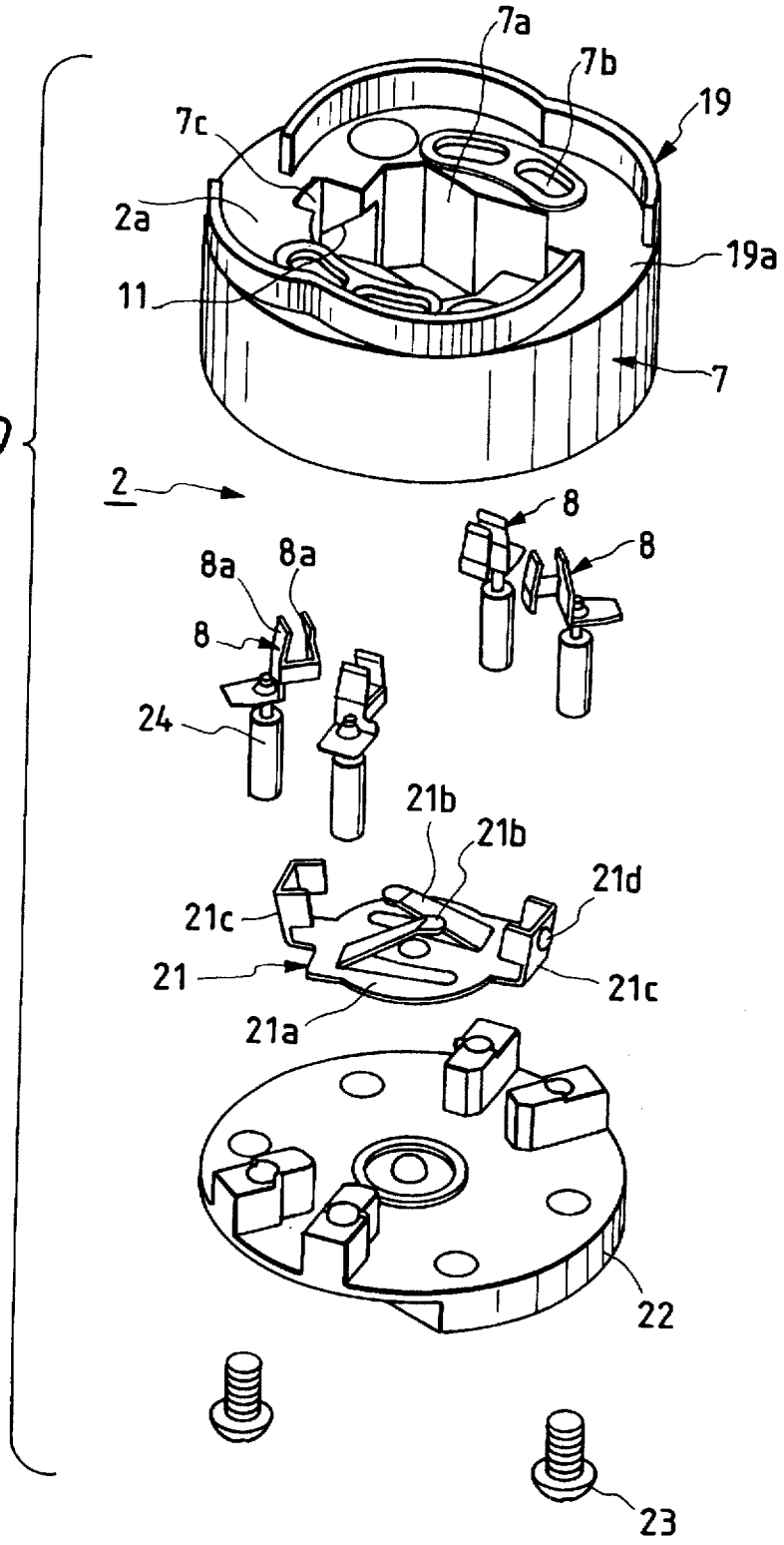
FIG. 9 is an exploded perspective view of a single end lamp socket of the embodiment.

As shown in FIG. 9, the single end lamp socket 2 includes the socket body 7, conductor terminals 8, a lamp holding spring 21, and a cover 22. The socket body 7 has an opening at a substantially center portion of a lamp attaching face 2*a* to which the lamp is to be attached. When the cover 22 is attached to the body from the back side by screws 23, the opening forms a recess 7*a* into which the projection 17 of the single end lamp 1 is to be inserted so as to be rotatable by a predetermined angle, for example, about 18°. Two sets of two arcuate lamp pin insertion holes 7*b* are formed on a circumference which is outside the recess 7*a* and concentric with the recess 7*a*, so that the holes are paired with each other. Conductor plates 8 which are connected to external lead wires 24 are housed in the lamp pin insertion holes 7*b*, respectively. The conductor plates 8 have cramping pieces 8*a* which cramp the corresponding lamp pin 5 in the rotation direction of the single end lamp 1 and a vertical direction.

A protection wall 19 which substantially covers the base 4 of the single end lamp 1 stands on an outer periphery of the lamp attaching face 2*a* which is outside than the lamp pin insertion holes 7*b*. Cutaway portions are formed at positions of the protection wall 19 corresponding to the erroneous attachment prevention ribs 18 formed on the single end lamp 1, so as to serve as receiving portions 19*a* in which the erroneous attachment prevention ribs 18 are rotatable by a predetermined angle in accordance with rotation of the single end lamp 1. Insertion grooves 7*c* which communicate with the inner space of the recess 7*a* and into which the engaging projections 6 of the single end lamp 1 are to be inserted are formed on both sides of the recess which are not the sides where the lamp pin insertion holes 7*b* are formed. Spaces in which the engaging projection 6 are rotatable are formed in the insertion grooves 7*c* and on the side of the cover 22 so as to elongate in a direction along which the single end lamp 1 in the attaching process is to be rotated. The portions of the spaces on the side of the lamp attaching face 2*a* function as engaging portions 11 which abut against the engaging projection 6 so as to be engaged with the single end lamp 1.

Figure 10:
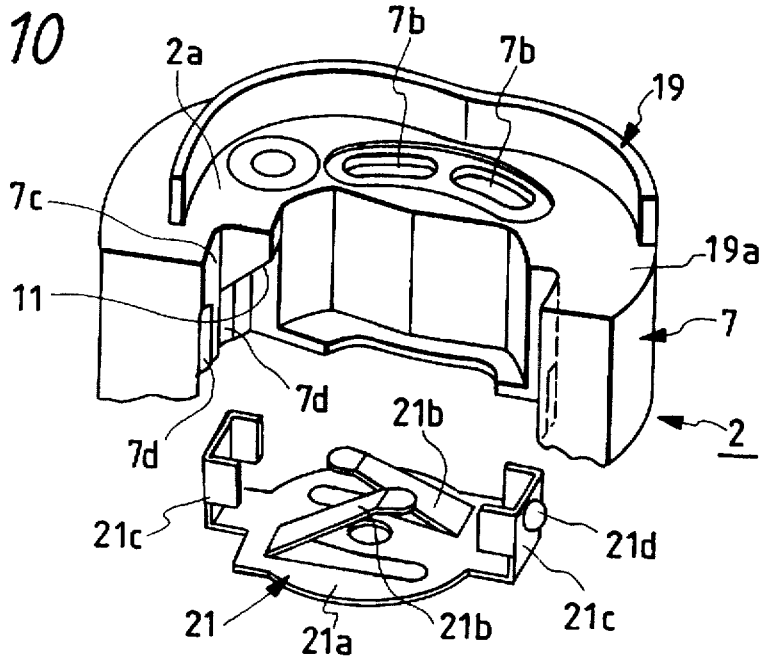
FIG. 10 is an exploded perspective view of the main portions of the embodiment, in partial cutaway.

As shown in FIG. 10, in the lamp holding spring 21, raised portions 21*b* are formed at a substantially center portion of a plate member 21*a* so as to elongate from the respective sides and in the circumferential direction. Mounting legs 21*c* which are bent so as to form an obtuse angle to the plate member 21*a* are disposed at the ends of the plate member 21*a*. A protrusion 21*d* protrudes from the outer face of each of the mounting legs 21*c*. The lamp holding spring 21 is housed in the recess 7*a*, in such a manner that the plate member 21*a* abuts against the cover 22, the lamp holding spring 21 can be rotated about the center axis of the recess 7*a* by a predetermined angle as the single end lamp 1 is rotated, and the lamp holding spring is prevented from slipping off toward the lamp attaching face 2*a*. Dents 7*d* with which the protrusions 21*d* are engaged are formed at positions of the side wall of the recess 7*a* which oppose the protrusions 21*d* at the start and completion of attachment of the single end lamp 1.

Figure 11:
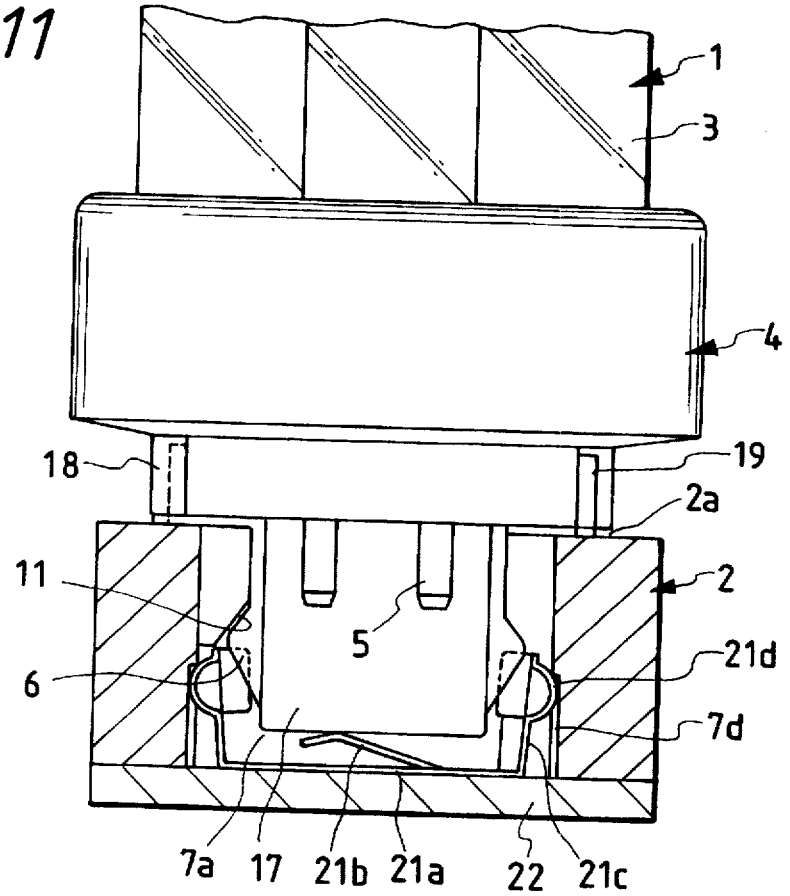
FIG. 11 is a front view of the embodiment, in partial section.

In the thus configured lighting device, as shown FIG. 11, the single end lamp 1 is attached to the single end lamp socket 2 in the following manner. The erroneous attachment prevention ribs 18 of the single end lamp 1 are inserted in a direction perpendicular to the lamp attaching face 2*a* into the single end lamp socket 2 with being aligned with receiving portions 19*a*. This causes the projection 17 to be inserted into the recess 7*a*, and the lamp pins 5 to be inserted into the lamp pin insertion holes 7*b*. While pressing the lamp holding spring 21, the single end lamp 1 is twisted, whereby the single end lamp 1 is rotated together with the lamp holding spring 21 about the center axis in the projection direction of the bulb 3. As a result, the lamp pins 5 are cramped by the cramping pieces 8*a* of the conductor plates 8, and the protrusions 21*d* of the lamp holding spring 21 are engaged with the dents 7*d* formed in the socket body 7, thereby producing clicking sensation. When the rotation is stopped under this state, the single end lamp 1 is attached to the single end lamp socket 2. Since the protrusions 21*d* are engaged with the dents 7*d*, the single end lamp 1 is prevented from being accidentally rotated in the reverse direction.

Figure 12:
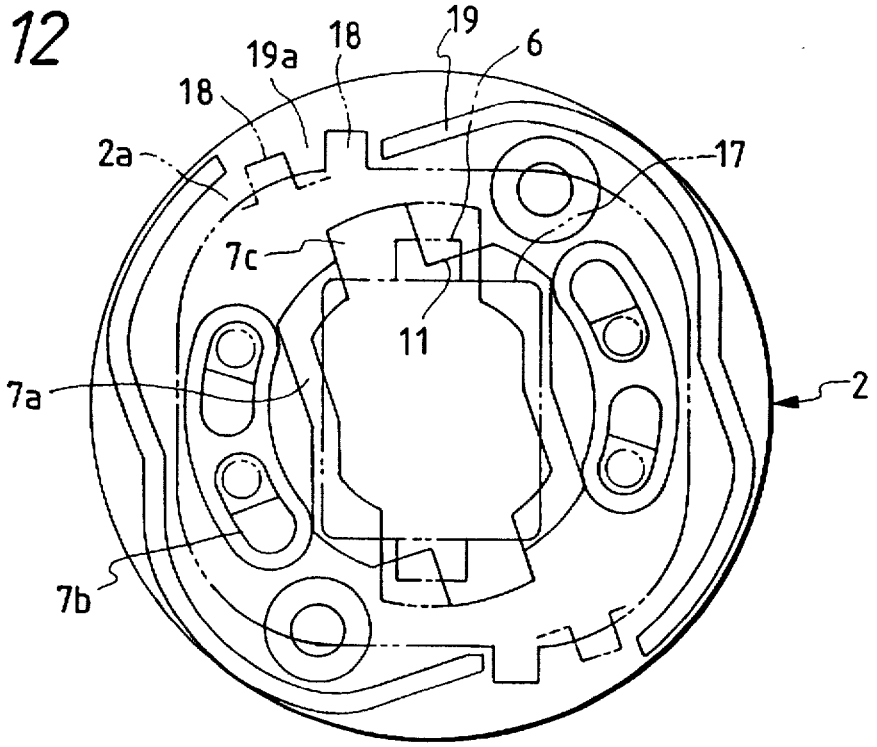
FIG. 12 is a plan view of the main portions of the embodiment.
Figure 13:
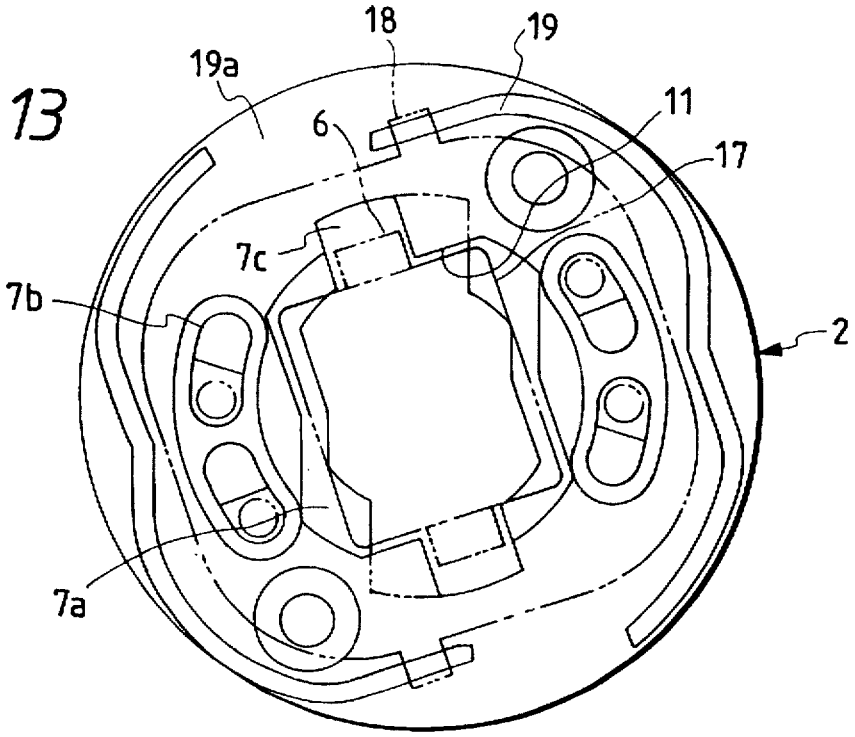
FIG. 13 is a plan view of the main portions of the embodiment in a different state.

FIG. 12 shows an example in which both the single end lamp 1 and the single end lamp socket 2 comply with G24q-3 of above-mentioned IEC 61 standard or match each other. In the example, specifically, when the engaging projections 6 of the base 4 are fitted into the insertion grooves 7*c* of the socket boy 7, the erroneous attachment prevention ribs 18 are rotatable by a predetermined angle in the receiving portions 19*a*. In the figure, 18 indicated by a broken line shows the position of the erroneous attachment prevention rib 18 under the state where the single end lamp 1 is inserted into the single end lamp socket 2. FIG. 13 shows an example in which the single end lamp 1 complies with G24q-3 of above-mentioned IEC 61 standard and the single end lamp socket 2 with G24q-1 or in which the single end lamp 1 and the single end lamp socket 2 fail to match each other. In the example, the erroneous attachment prevention ribs 18 override the protection wall 19 and hence it is impossible to conduct attachment.

In the lighting device of the embodiment, since the lighting device is configured as described above, the single end lamp 1 having the projection 17 which is further projected from the bottom 4*a* of the base 4 than the lamp pins 5 can be rotatively engaged by inserting the lamp into the single end lamp socket 2 and twisting the lamp. Since the engaging projections 6 formed on the projection 17 of the base 4 are fixed with being engaged with the engaging portions 11 formed on the side wall of the recess 7*a* of the socket body 7, a strong resistance can be exerted against a pulling force acting on the single end lamp 1, and, even when an impact, vibrations, or the like are applied to the lighting device, the single end lamp 1 hardly slips off by accident. The protection wall 19 blocks attachment of the single end lamp 1 which does not match a lighting circuit, etc. incorporated in the lighting device, thereby preventing erroneous attachment from occurring. Furthermore, the protrusions 21*d* of the lamp holding spring 21 are engaged with the dents 7*d* of the socket body 7 so that clicking sensation is produced. In the operation of attaching or detaching the single end lamp 1, completion of the operation can be easily recognized.

Second embodiment

Figure 14:
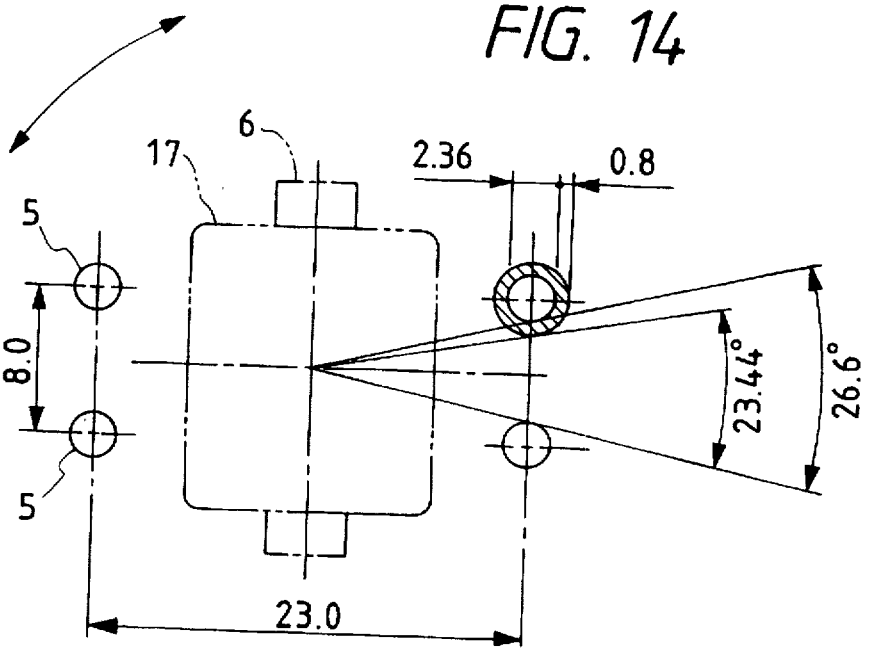
FIG. 14 is a diagram showing the main portions of a second embodiment of the lighting device of the invention.
Figure 15:
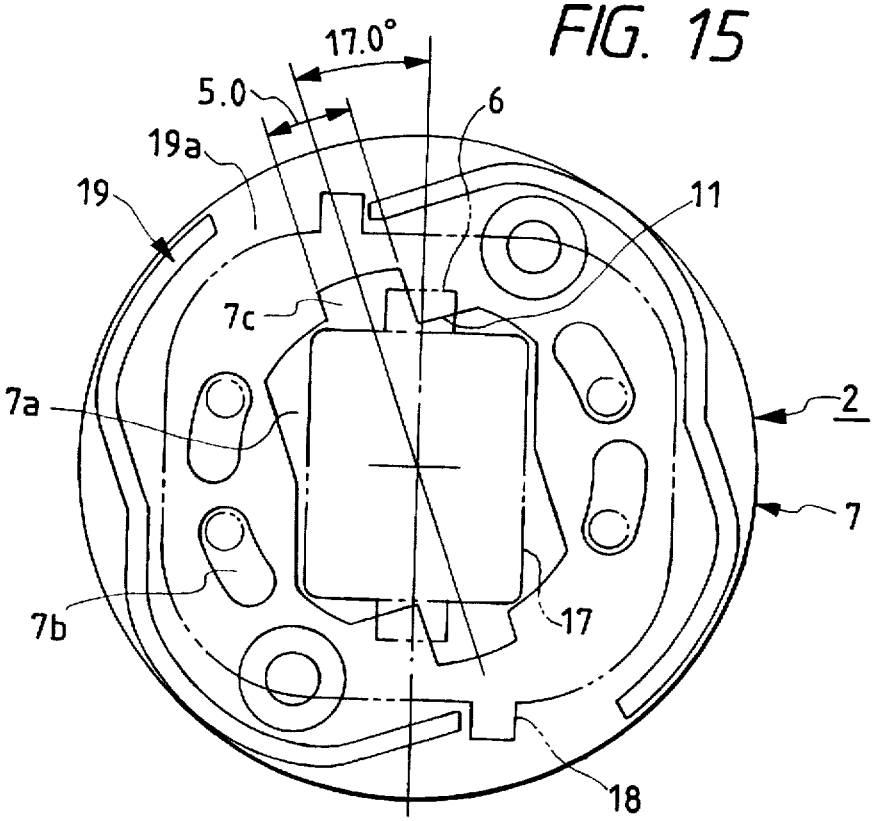
FIG. 15 is a plan view of the main portions of the embodiment.

FIGS. 14 and 15 show a second embodiment of the lighting device of the invention. In the embodiment, the rotation angle of the single end lamp 1 is different from that in the first embodiment, and the other components are configured in a similar manner as those of the first embodiment.

The distance between two adjacent lamp pins 5 of the single end lamp 1 is 8 mm. Usually, it is preferable to dispose an insulation wall of 0.8 mm or more between lamp pins of different polarities. As shown in FIG. 14, therefore, the minimum rotation angle of the single end lamp 1 is set to be 23.44 or less, or about 23° or less so that a distance of 0.8 mm is ensured between one of the lamp pins 5 and a virtual position where another one of the lamp pins 5 is situated as a result of rotation of the lamp. According to the above-mentioned standard or IEC 61, the insertion grooves 7*c* which communicate with the recess 7*a* of the single end lamp socket 2 must have the width of 5 mm at the minimum. At this time, the minimum rotation angle of the single end lamp 1 is set to be 17° or more so that, as shown in FIG. 15, the engaging projections 6 overlap the engaging portions 11 by a distance which is greater than one half the dimension of the engaging projections 6 in the rotation direction.

In the lighting device of the embodiment, since the lighting device is configured as described above, the following effects can be attained in addition to the effects of the lighting device of the first embodiment. When the rotation angle of the single end lamp 1 is set to be 17° or more, the portions of the engaging projections 6 which are not less than one half overlap the engaging portions 11 and hence the lamp is surely prevented from slipping off. When the rotation angle is set to be 23° or less, an insulation wall of 0.8 mm or more can be formed between adjacent lamp pins of different polarities and hence the safety is ensured.

Third embodiment

Figure 16:
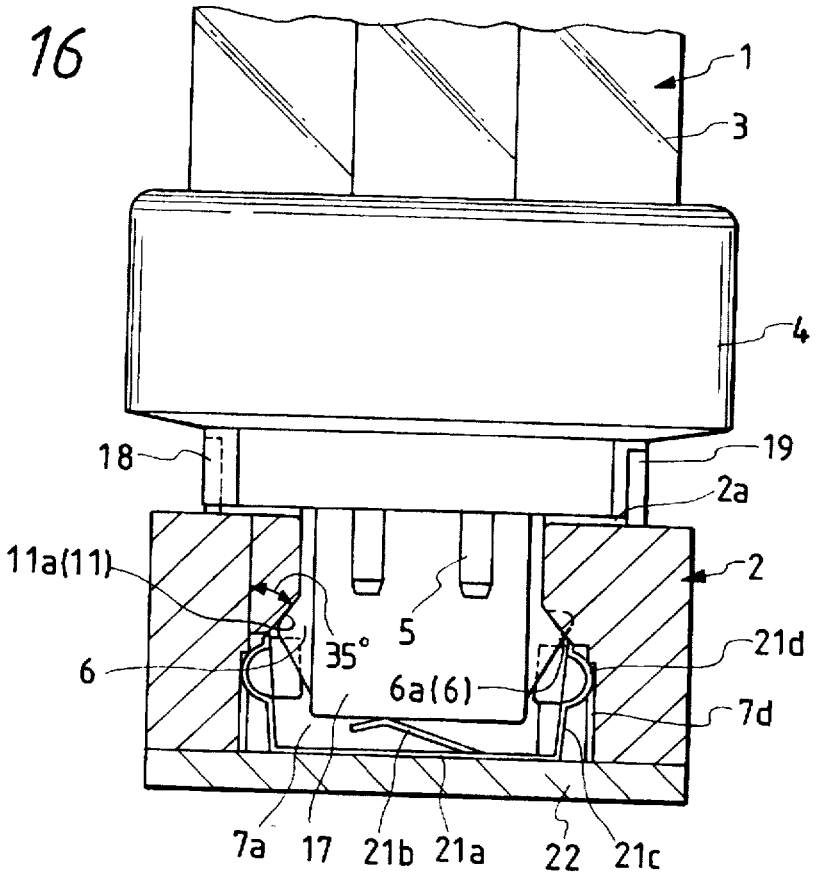
FIG. 16 is a front view showing the main portions of a third embodiment of the lighting device of the invention, in partial section.
Figure 17:
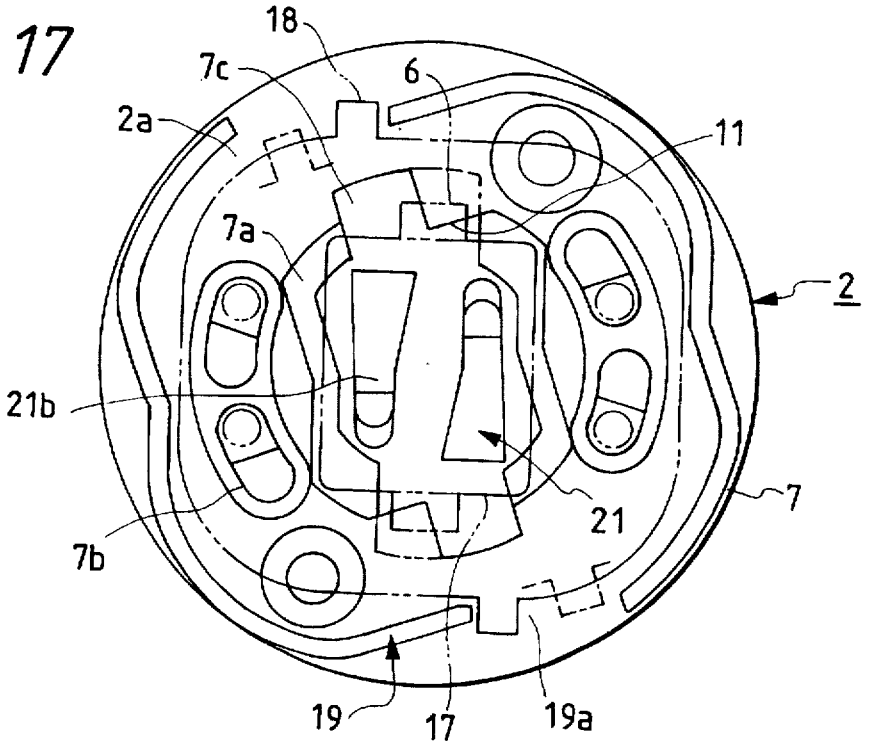
FIG. 17 is a plan view of the main portions of the embodiment.

FIGS. 16 and 17 show a third embodiment of the lighting device of the invention. In the embodiment, the engaging portions 11 of the single end lamp 1 are different from those in the first embodiment, and the other components are configured in a similar manner as those of the first embodiment.

The engaging portions 11 of the single end lamp 1 are formed so as to make surface contact with the engaging projections 6 disposed on the projection 17 of the single end lamp 1. Specifically, the engaging projections 6 of the projection 17 have an inclined face 6*a* of a predetermined angle or 35° with respect to the center axis of the projection 17, so that the degree of the lateral projection from the projection 17 is increased as moving from the bottom 4*a* of the base 4 toward the tip end of the projection 17. Also the engaging portions 11 of the single end lamp 1 have an abutting face 11*a* which has an inclination corresponding to the inclined faces 6*a* or 35°, so that the abutting faces abut against the inclined faces 6*a*.

The single end lamp 1 has a weight of about 100 g. When the bulb is to be horizontally directed, the lamp is attached so that the engaging projections 6 are vertically directed. The lamp holding spring 21 is configured so as to urge the projection 17 toward the bulb 3 under this state by a force of about 1 to 2 kgf.

In the lighting device of the embodiment, since the lighting device is configured as described above, the following effects can be attained in addition to the effects of the lighting device of the first embodiment. Even when the portions of the engaging projections 6 of the single end lamp 1 which abut against the engaging portions 11 have an inclined face forming an angle with respect to the center axis of the projection 17, the lamp can be surely engaged with the single end lamp socket 2. Since the single end lamp 1 is urged by the lamp holding spring 21 toward the bulb 3 and held under the state where the inclined faces 6*a* make surface contact with the abutting faces 11*a*, inclination and rattling of the single end lamp 1 in the direction along which the engaging projections 6 are disposed can be reduced in degree. Even when the single end lamp 1 is horizontally attached so that the sides on which the engaging projections 6 are disposed are vertically directed, the sag of the lamp due to its weight can be reduced in degree.

In the embodiment, the predetermined angles which are the inclination angles of the inclined faces 6*a* and the abutting faces 11*a* are set to be 35°. The inclination angles are not restricted to the above-mentioned value or 35°, and have any value.

Fourth embodiment

Figure 18:
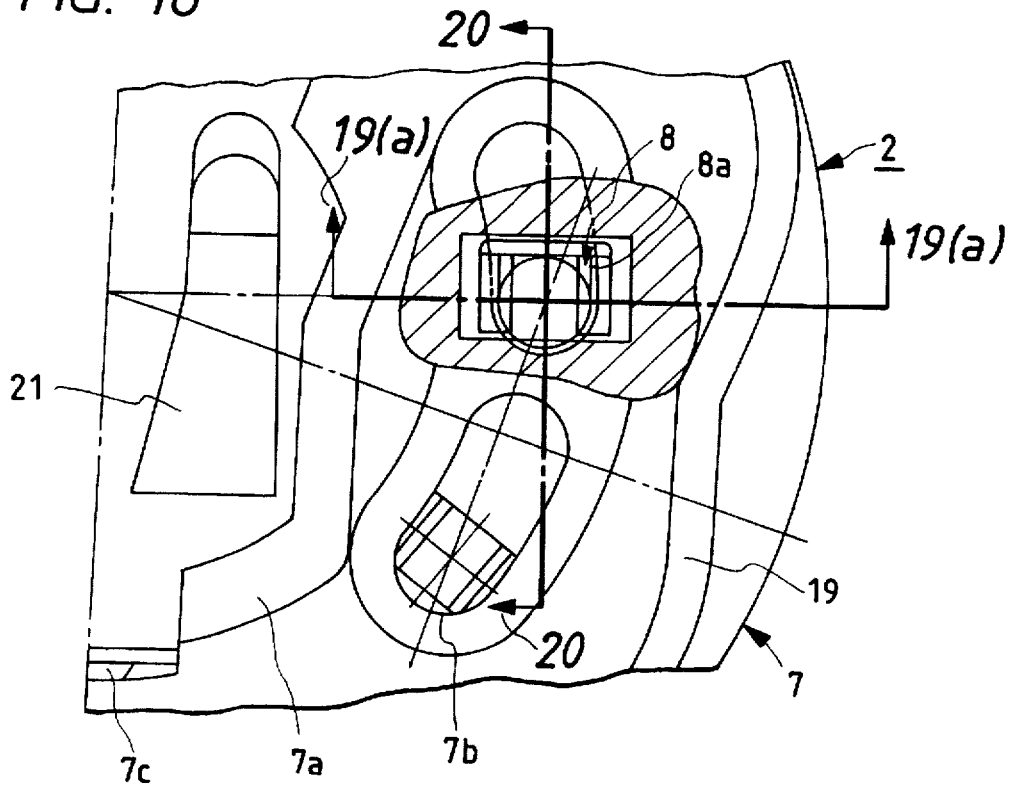
FIG. 18 is a plan view showing the main portions of a fourth embodiment of the lighting device of the invention, including a partial enlarged view.
Figure 20:
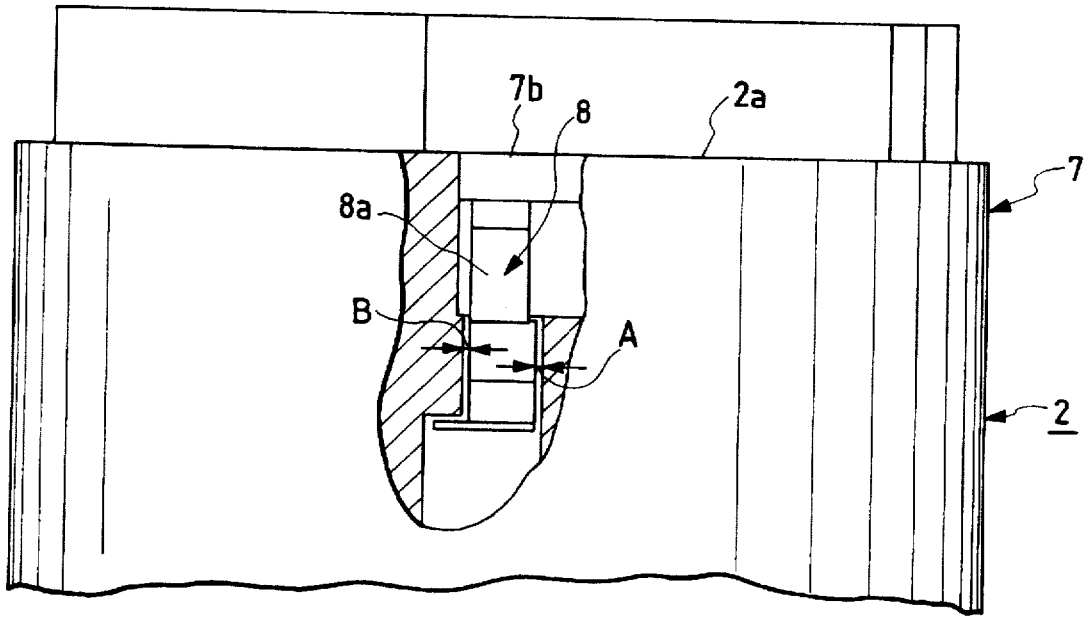
FIG. 20 is a front view of the embodiment, including a section view taken along the line Y—Y in FIG. 11.
Figure 19A:
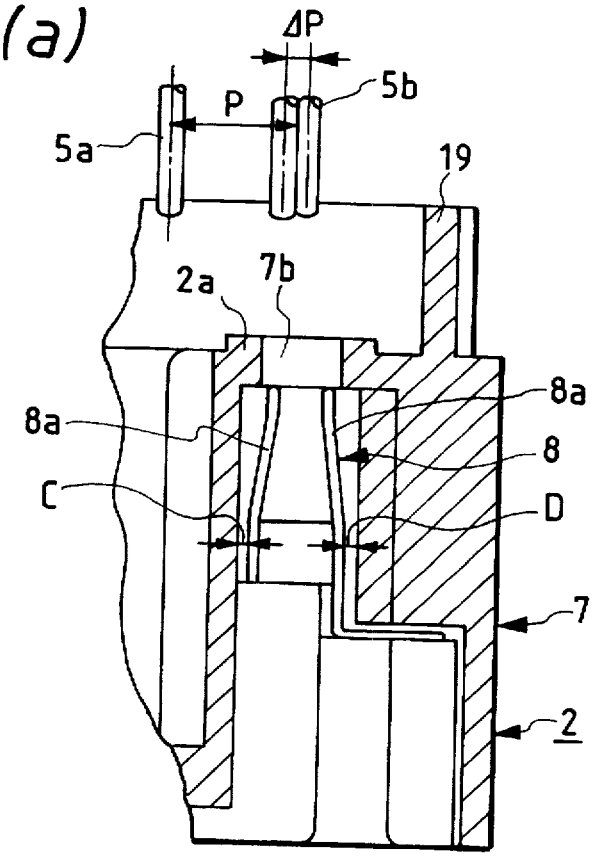
FIG. 19 (*a*) is a side view of the embodiment, including a section view taken along the line X—X in FIG. 11.
Figure 19B:
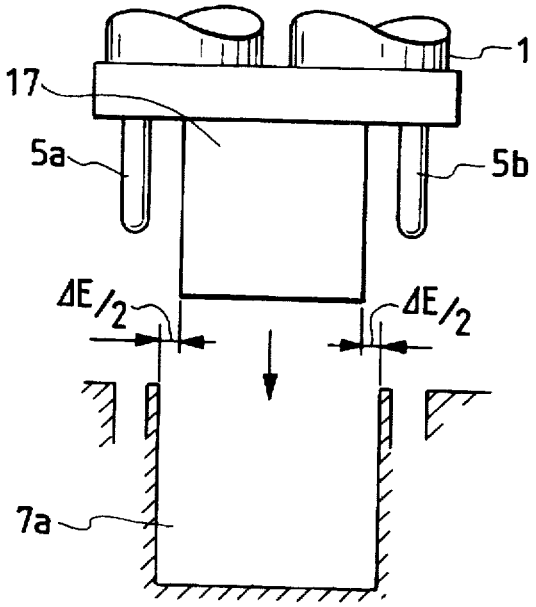
Figure 21:
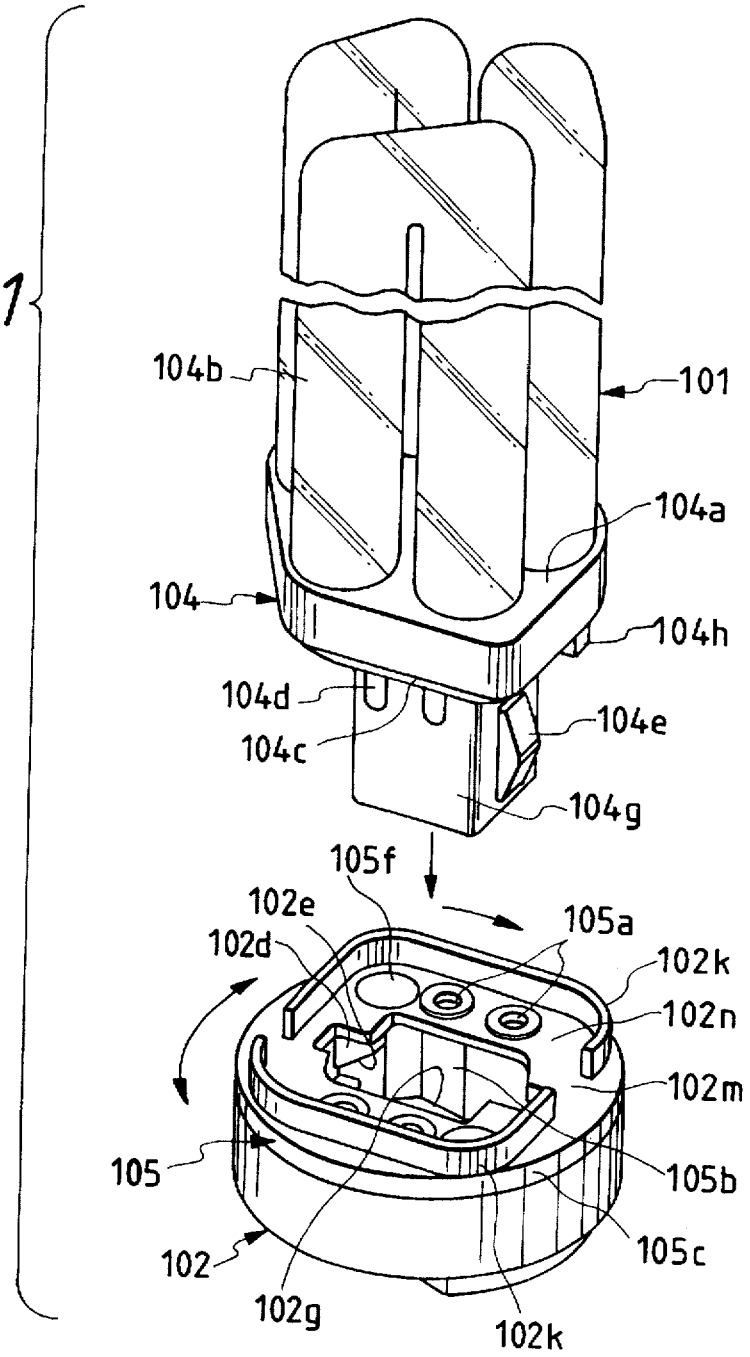
FIG. 21 is a perspective view showing a fifth embodiment of the single end lamp socket of the invention.

FIGS. 18 to 20 show a fourth embodiment of the lighting device of the invention. The embodiment is different from the first embodiment in the dimension of the clearance between each of the conductor plates 8 and the peripheral wall of the corresponding lamp pin insertion hole 7*b*, and the other components are configured in a similar manner as those of the first embodiment.

Each conductor plate 8 is configured so as to have the cramping pieces 8*a* which cramp the corresponding lamp pin 5. This configuration is employed because of the following reason. As lead wires elongating from the filament of the single end lamp 1 to the lamp pins 5, copper plated steel wires (CP wires) are frequently used. It is often that a tip end of such a wire is protruded from the corresponding lamp pin 5. When the power is supplied through the protruded lead wire, heat generation is increased because of reasons such as that the lead wire has a higher resistance, and that the section face of the steel wire easily rusts so that the contact resistance is increased, with the result that failures such as disconnection and burnout may occur. To comply with this, the lamp pins 5 are cramped so that a sure electrical connection is attained.

With respect to each of the conductor plates 8, in the direction along the section Y—Y of FIG. 18, or a direction which is substantially parallel to the rotation direction of the lamp pin 5, the rotation of the lamp pin 5 causes the tip end of the conductor plate 8 to move in the attachment or detachment direction. In order to maintain the movement in an appropriate range, the clearances A and B at both sides are formed so as to have a value as small as possible. In a direction perpendicular to the rotation direction of the lamp pin 5, or a direction perpendicular to the cramping pieces 8*a*, the clearances C and D are formed so as to be larger than the movable distance of the lamp pin 5 in order to absorb pitch variation of the lamp pins 5, etc.

When pitch variation of the lamp pins 5 is indicated by ΔP, the maximum moving distance of the lamp pins 5 in a direction perpendicular to the rotation direction in the case where the lamp is held by the socket is indicated by ΔE, and it is assumed that ΔE is movement which is symmetrical about the center, the clearances C and D are set so as to satisfy the following relationship:

$$C(\text{or } D)>(\Delta P+AE/2)$$

The relationship will described in more detail. As shown in FIGS. 19 (*a*), when the lamp pin 5*a* is fixed in a horizontal direction, the pitch variation of the lamp pins ΔP exists. If an elastic deformation of the lamp pin 5 is in small, it is necessary to move the whole conductor plate 8 in the horizontal direction so as to absorb the pitch variation of the lamp pins ΔP. There is satisfied a following equation:

$$C>\Delta P$$

As shown in FIG. 19 (*b*), in other words, the maximum moving distance ΔE corresponds to a clearance between the single end lamp 1 and the recess 7*a*. At that time, there is pointed out one side lamp pin 5*b*. Assuming that the lamp pin 5*b* moves in a direction forwarded to the axis of the single end lamp 1, it is necessary to absorb ΔE/2 by the contact 8. There is satisfied a following equation:

$$C>\Delta E/2$$

In the lighting device of the embodiment, since the lighting device is configured as described above, the following effects can be attained in addition to the effects of the lighting device of the first embodiment. The elasticity range of the conductor plates 8 is not impaired by movement of the conductor plates 8 which may be caused by pitch variation of the lamp pins 5, rattling of the conductor plates 8, or the like. Therefore, the single end lamp 1 can be surely attached to the socket.

In the above, the first to third embodiments in which the conductor plates 8 have the cramping pieces 8*a* have been described. The invention is not restricted to this. Alternatively, conductor plates against which the tip ends of the lamp pins 5 are to abut may be used. In the embodiments, the base 4 having the four lamp pins 5 specified as G24q-1, G24q-2, and G24q-3 in IEC 61 (IEC Publication 61-1 7004-78) has been described. The invention is not restricted to this. Alternatively, any kind of the base may be used as far as it has one or more lamp pins. For example, the base may have two lamp pins specified as G24d-1, G24q-2, and G24q-3 in IEC 61 and JIS C7709 (IEC publication). When the base having a single lamp pin is used, another electrode is disposed at the tip end of or in the vicinity of the projection.

Fifth embodiment

Figure 1:
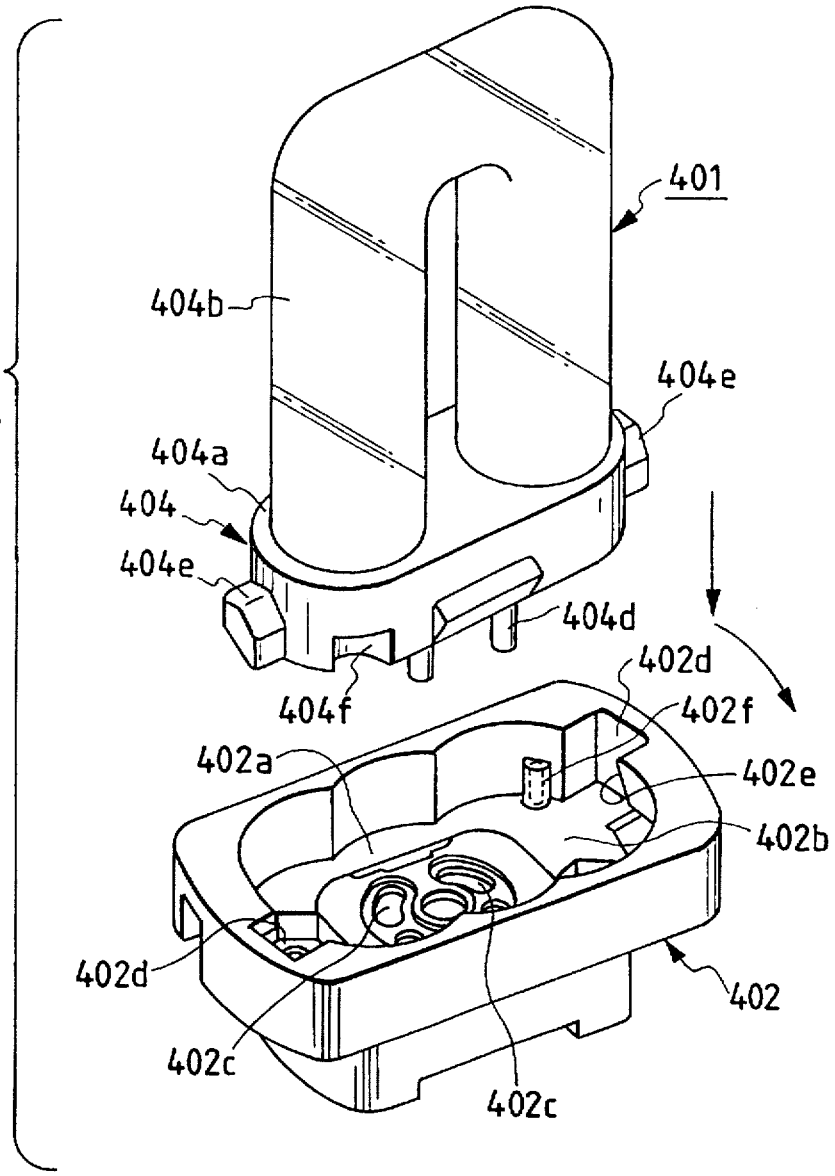
FIG. 1 PRIOR ART
FIG. 1 is a perspective view showing a single end lamp socket of a first conventional art.
Figure 2A:
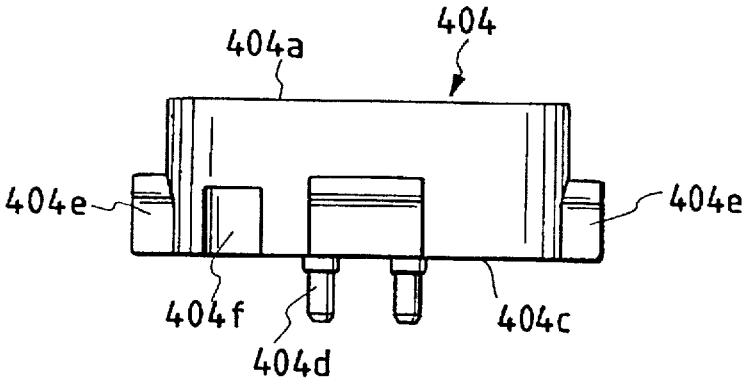
FIG. 2(a) PRIOR ART
FIG. 2(*a*) is a front view showing a base of a lamp which is to be attached to the socket.
Figure 2B:
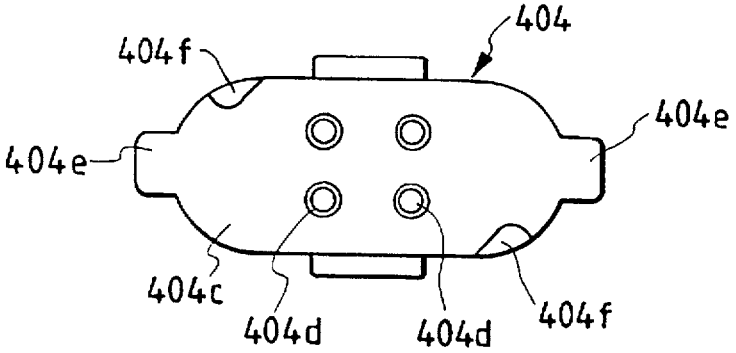
FIG. 2(b) PRIOR ART
Figure 2C:
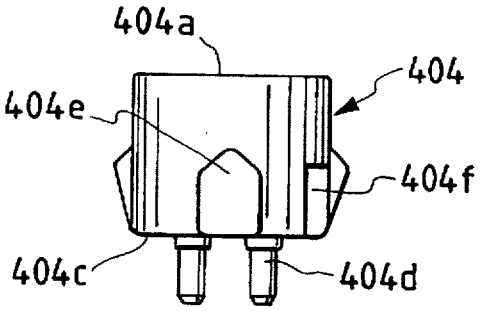
FIG. 2(c) PRIOR ART
Figure 3:
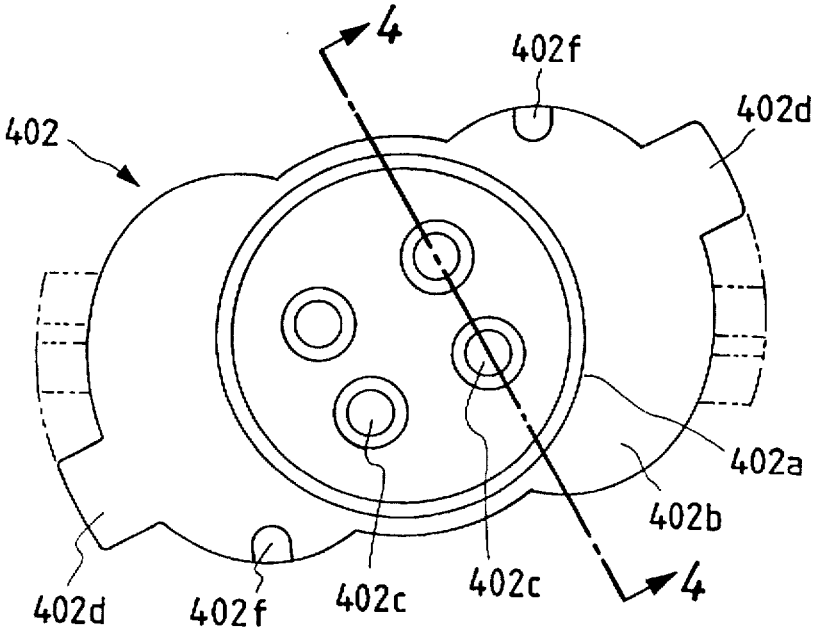
FIG. 3 PRIOR ART
FIG. 3 is a plan view showing the main portions of the base.
Figure 4:
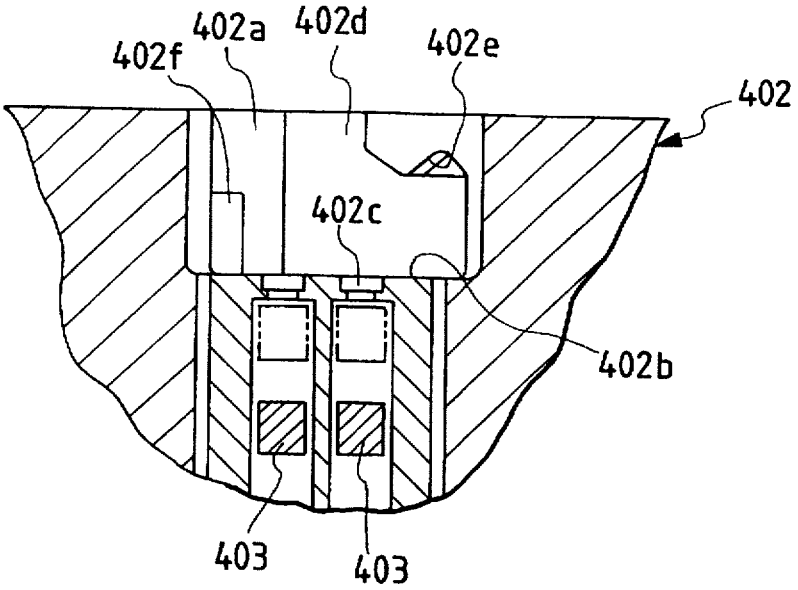
FIG. 4 PRIOR ART
FIG. 4 is a section view showing the main portions and taken along the line A—A.
Figure 7:
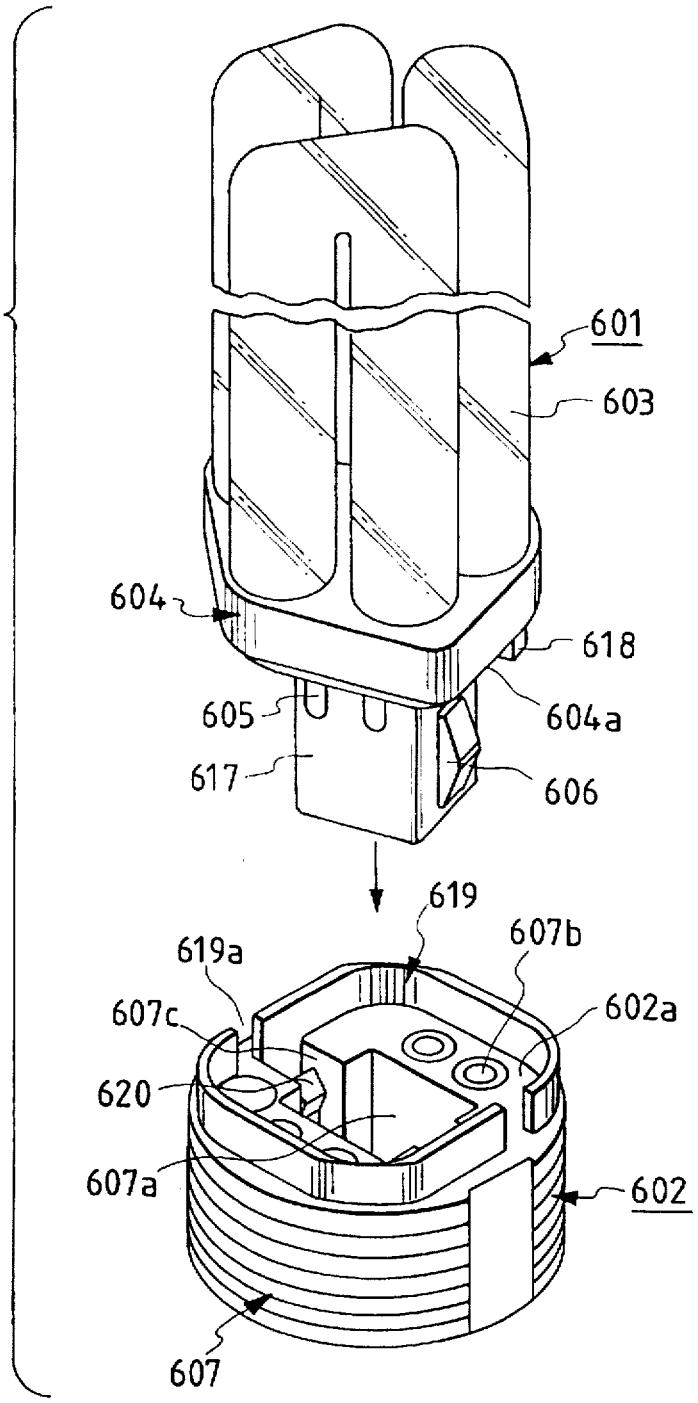
FIG. 7 PRIOR ART
FIG. 7 is a perspective view showing the main portions of a lighting device of a third conventional art.

FIGS. 21 to 25 show a fifth embodiment of the single end lamp socket of the invention. The single end lamp socket is a socket to which the same lamp as the single end lamp 1 shown in FIG. 7 is to be attached, and includes a socket body 102, contacts 103, a rotor 105, a lamp holding spring 107, and a cover 108.

Figure 22A:
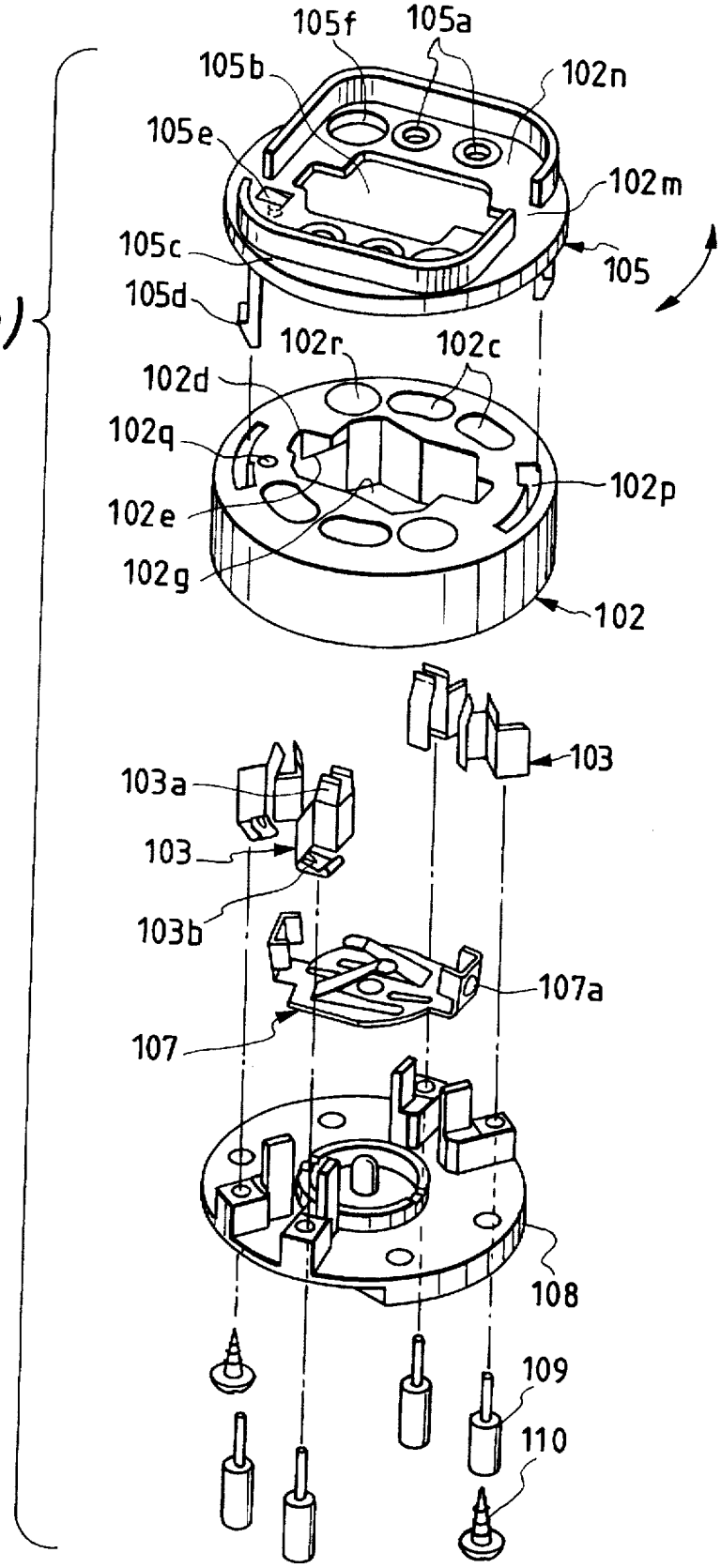
FIG. 22 (*a*) is an exploded perspective view of the fifth embodiment.
Figure 22B:
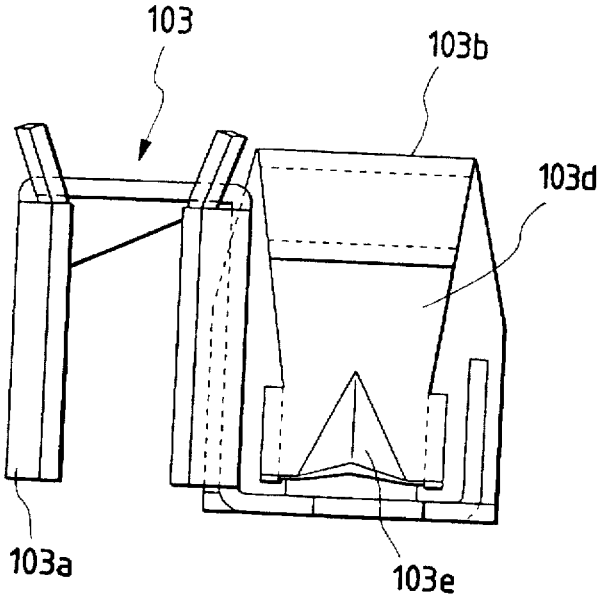
Figure 22C:
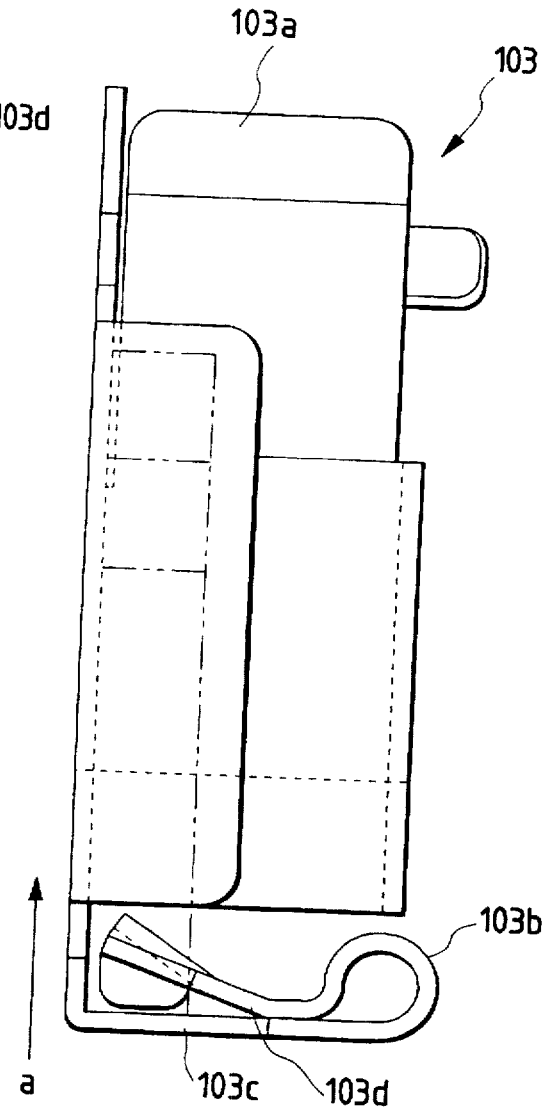
Figure 23:
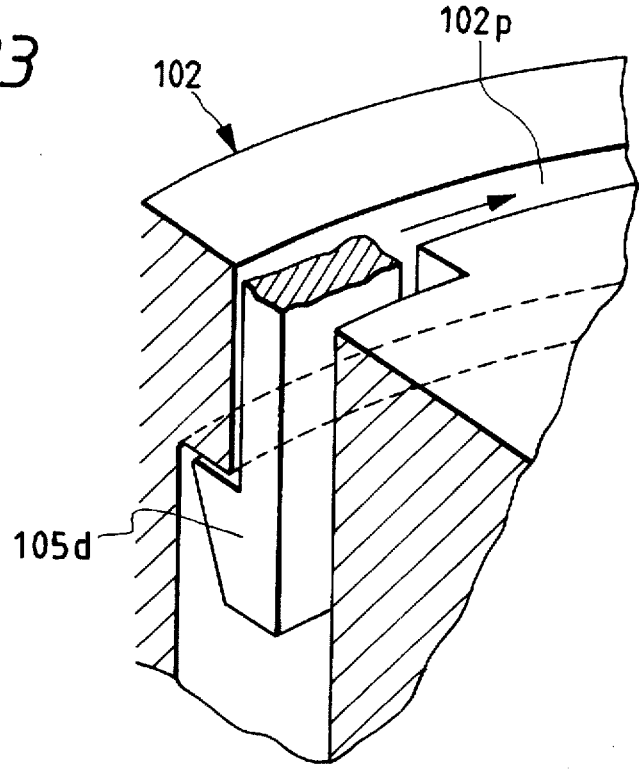
FIG. 23 is a perspective view of the main portions of the embodiment, in partial cutaway.
Figure 25A:
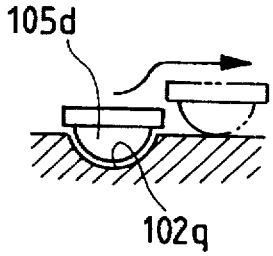
FIGS. 25(*a*) and 25(*b*) show other portions of the embodiment, FIG. 25(*a*) is a plan view showing the operation of a resin spring, and FIG. 25(*b*) is a section view showing the operation of a lamp holding spring.
Figure 25B:
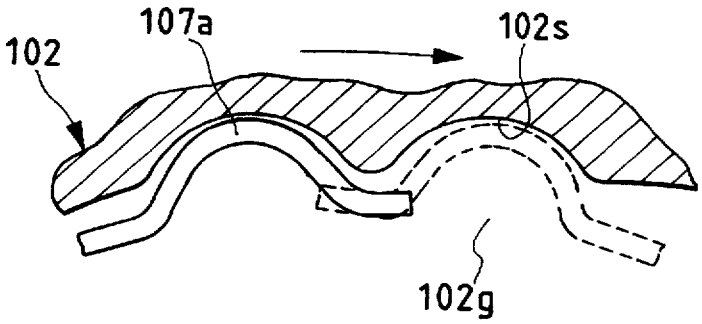
Figure 24A:
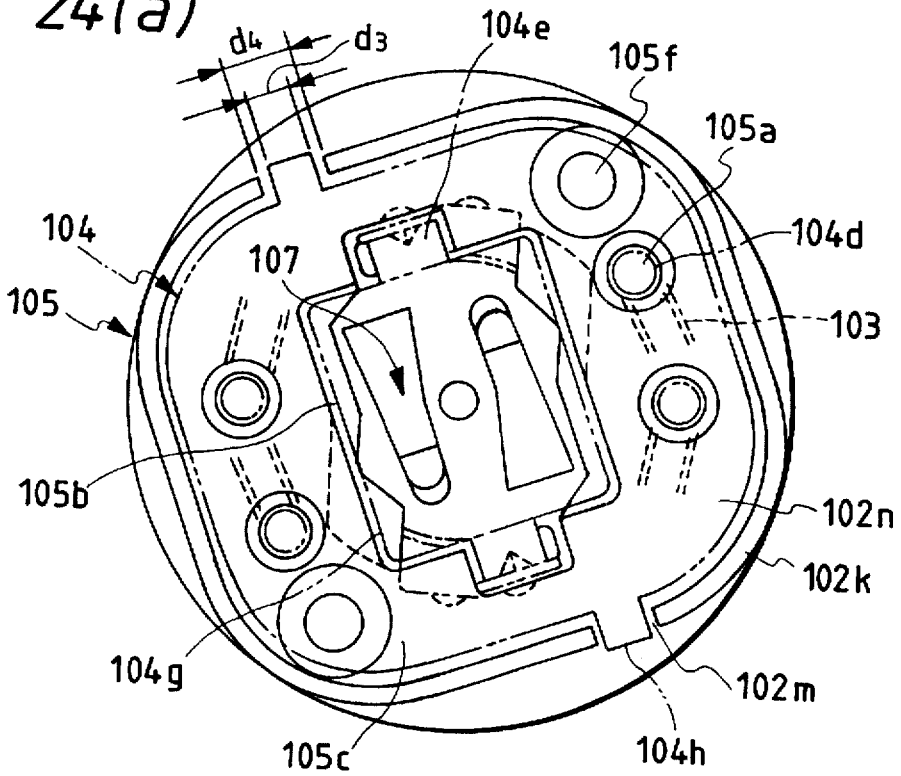
FIGS. 24(*a*) and 24(*b*) show steps of attaching a lamp in the embodiment, FIG. 24(*a*) is a plan view showing an insertion state, and FIG. 24(*b*) is a plan view showing an attachment completion state.
Figure 24B:
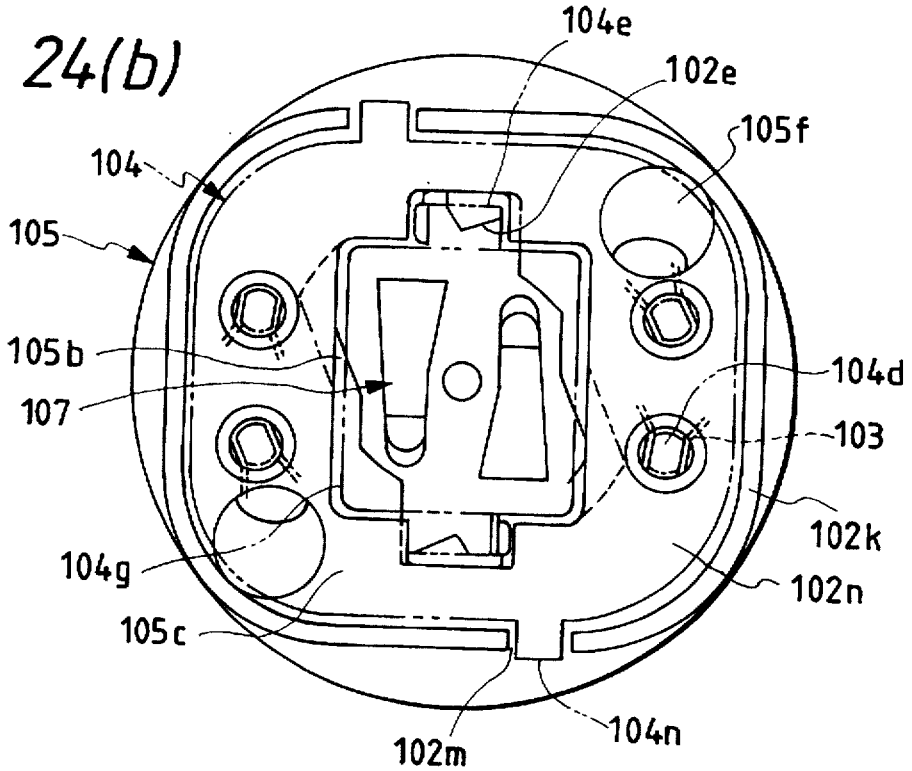

The socket body 102 is made of an insulative synthetic resin, and includes a hosing recess 102*g* at a substantially center portion of the lamp fitting face which is on the front side. A projection 104*g* of a single end lamp 101 is to be inserted into the recess and rotatable by a predetermined angle. Two sets of two substantially arcuate lamp pin insertion holes 102*c* are formed on the lamp fitting face which is on the outer face side of the housing recess 102*g*, so that the holes oppose with each other across the housing recess 102*g*. Insertion grooves 102*d* which have an L-like shape and communicate with the housing recess 102*g* are formed in the peripheral wall of the housing recess 102*g*. Lock engaging portions 104*e* of the single end lamp 1 are to be inserted into the insertion grooves and rotatable by a predetermined angle. The front faces of the insertion grooves 102*d* which are inner portions and on the side where the rotation of the lamp in the attaching operation is terminated function as engaging portions 102*e* which abut against the lock engaging portions 104*e* so as to prevent the single end lamp 1 from slipping off. Rotor engaging grooves 102*p* are formed in the vicinity of the peripheral edge of the lamp attaching face which is the front side, so as to oppose each other across the housing recess 102*g*. The rotor engaging grooves 102*p* have a substantially arcuate shape in a plan view. In the grooves, the section width of the innermost portion is larger than that of the front portion. A positioning hole 102*q* which is used for positioning the rotor 105 and the socket body 102 is formed on the lamp attaching face of the socket body 102 and in the vicinity of one of the rotor engaging grooves 102*p*. In FIG. 22, 102*r* designates socket mounting holes which are used for mounting the socket to a lighting device or the like.

The contacts 103 are formed by of an electrically conductive member, and housed in innermost portions of the lamp pin insertion holes 102*c* of the socket body 102 and on the side where the rotation in the attaching operation is terminated. The contacts 103 includes cramping pieces 103*a* which cramp the side faces of lamp pins 104*d* that is inserted into the lamp pin insertion holes 102*c* and then rotated, hereby attaining the electrical connection. Quick-connection terminals 103*b* to which external wires 109 are to be connected are integrally formed at the ends of the contacts which are opposite to the ends where the cramping pieces 103*a* are formed.

As shown in FIGS. 22 (*b*) and (*c*), the quick connection terminal 103*b* has a cantilevered rib 103*d*. The external wire 109 is inserted into a through hole 103 in a direction depicted by arrow a. When the external wire 109 is inserted, the external wire 109 is held between the quick connection terminal 103*b* and the body of quick-connection terminal 103*b*. Once the external wire 109 is inserted, a wire holding projection 103*e* holds the external wire 109 to avoid the disengagement from the contacts 103.

The rotor 105 is made of an insulative synthetic resin, and includes the following components which are integrally formed: a plate-like rotor base 105*c* in which an opening 105*b* of a shape substantially equal to the section shape of the projection 104*g* including the lock engaging portions 104*e* is formed at a position substantially opposing the housing recess 102*g* and the insertion grooves 102*d*; a partition wall 102*k* which stands in the vicinity of the periphery edge of the upper face of the rotor base 105*c*; rotor engaging claws 105*d* which are projected from the lower face of the rotor base 105*c* and engaged with the rotor engaging grooves 102*p* so as to rotatably engage the rotor 105 with the socket body 102; and a resin spring 105*e* for positioning the rotor 105 with respect to the socket body 102. The portion of the upper face of the rotor base 105*c* which is inside the partition wall 102*k* functions as a base abutting face 102*n* which substantially abuts against the lower face 104*c* of the base 104. Small holes 105*a* through which the lamp pins 104*d* are to be inserted are formed in portions of the base abutting face 102*n* which oppose the lamp pin insertion holes 102*c*. A receiving groove 102*m* which is a cutaway portion for avoiding collision with an identification projection 104*h* of the single end lamp 1 is formed in the partition wall 102*k*. The width d4 of the receiving groove 102*m* in the rotation direction of the base 104 is slightly larger than the width d3 of the identification projection 104*h*. In the figures, 105*f* designates through holes facing the socket mounting holes 102*r* formed in the socket body 102.

The lamp holding spring 107 is disposed on the bottom of the housing recess 102*g* of the socket body 102, and rotated together with the projection 104*g* of the single end lamp 1 so as to urge the projection 104*g* toward the front face, thereby pressing the lock engaging portions 104*e* against the engaging portions 102*e* so as to be held thereto. The lamp holding spring 107 includes protrusions 107*a* at the portions opposing the side wall of the hosing recess 102*g*. When the protrusions 107*a* engaged with click grooves 102*s* formed in the side wall of the housing recess 102*g*, attachment sensation indicative completion of attachment of the single end lamp 1 is generated. The cover 108 is made of an insulative synthetic resin and formed so as to hold the contacts 103 and the lamp holding spring 107 at predetermined positions of the socket body 102. After these components are housed, the cover is placed on the back of the socket body 102 and then attached to the socket body 102 by screws 110.

In the thus configured single end lamp socket, the single end lamp 1 is inserted into the socket with aligning the identification projection 104*h* with the identification projection groove 102*m* of the rotor 105, and then rotated so as to accomplish the attachment the single end lamp 1. In this case, only the single end lamp 1 in which, when the projection 104*g* is inserted into the opening 105*b* of the rotor 105, the identification projection 104*h* can align with the identification projection groove 102*m*, i.e., a lamp of the rating matched with the socket allows the lamp pins 104*d* to be inserted into the mall holes 105*a* formed in the rotor base 105*c*, thereby completing the insertion. When the single end lamp 1 is rotated about the axis of the lamp under the state where the insertion is completed, the identification projection 104*h* laterally abuts against the partition wall 102*k* and the resin spring 105*e* passes through the positioning hole 102*q* so as to slide, thereby rotating the rotor 105. Thereafter, the lamp pins 104*d* are cramped by the contacts 103 and the lock engaging portions 104*e* are engaged with the engaging portions 102e, with the result that the single end lamp 1 is attached to the socket.

In the single end lamp socket of the embodiment, since the single end lamp socket is configured as described above, the width of the identification projection 104h of the single end lamp 1 can be made substantially equal to that of the receiving groove 102m of the socket body or set so as to have the minimal value. Consequently, a large number of combinations of the identification projection 104h and the receiving groove 102m which prevent erroneous attachment can be produced. Even when ratings of the lamp are increased in number so that the kinds of the single end lamp 1 are increased, a countermeasure for prevention of erroneous attachment can be easily taken. When the lamp is to be inserted, since the opening 105b of the rotor base 105c of the rotor 105 has substantially the same shape as the projection 104g, the positioning of the base 4 in the rotation direction can be easily done, thereby facilitating the attachment of the lamp. With respect to lamps of different ratings, prevention of erroneous attachment can be coped with only by replacing the rotor 105 with another one while commonly using the socket body 102. Consequently, the production cost can be lowered. When no lamp is attached, the base abutting face exists in front of the contacts 103 and hence the insulation properties can be easily ensured.

Sixth embodiment

Figure 26:
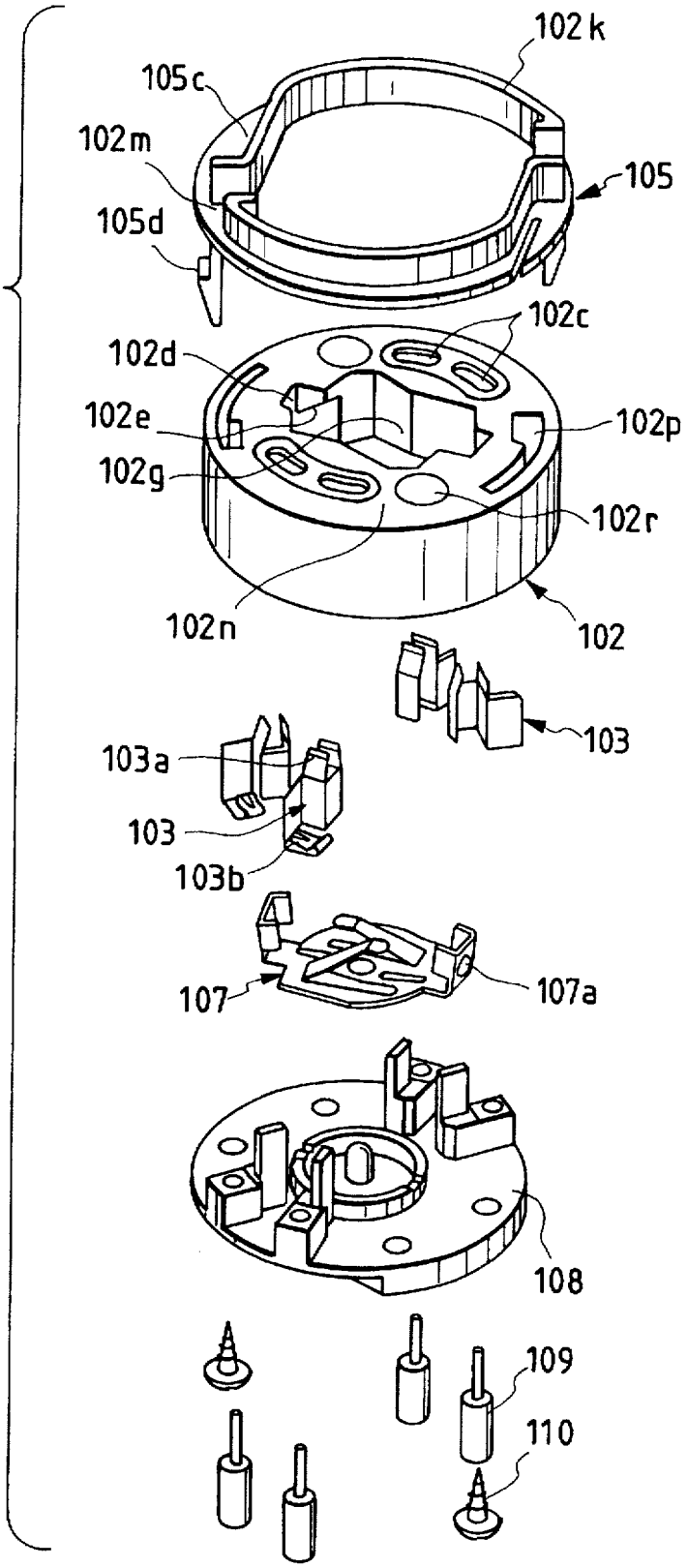
FIG. 26 is an exploded perspective view showing a sixth embodiment of the single end lamp socket of the invention.
Figure 27A:
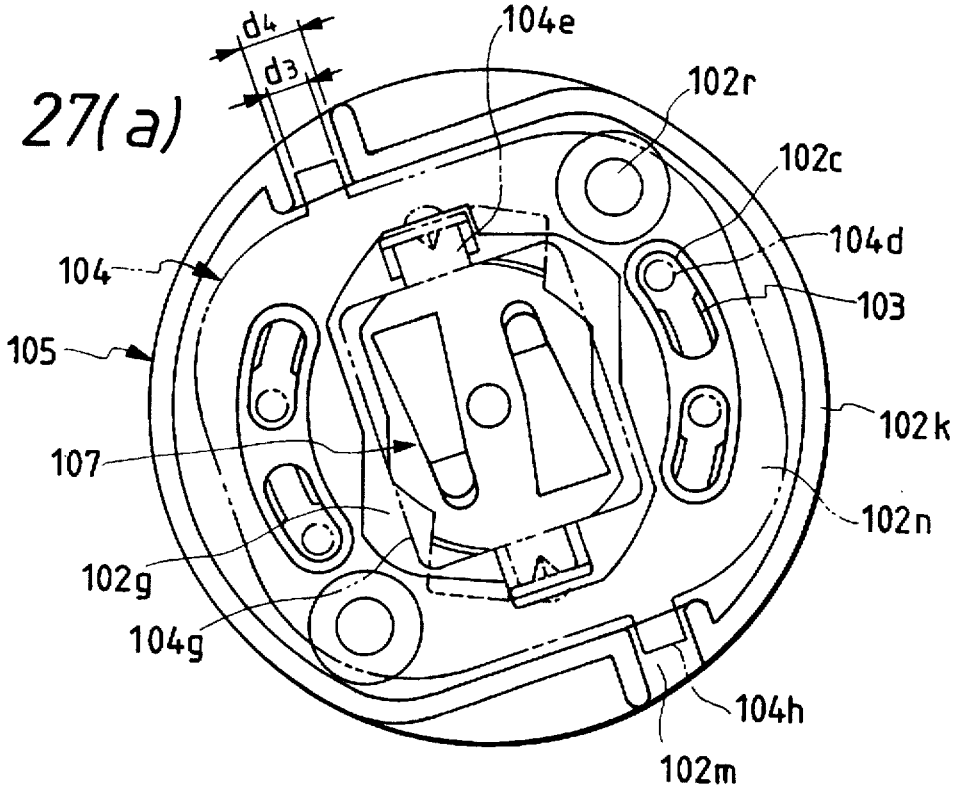
FIGS. 27(*a*) and 27(*b*) show steps of attaching a lamp in the embodiment, FIG. 27(*a*) is a plan view showing an insertion state, and FIG. 27(*b*) is a plan view showing an attachment completion state.
Figure 27B:
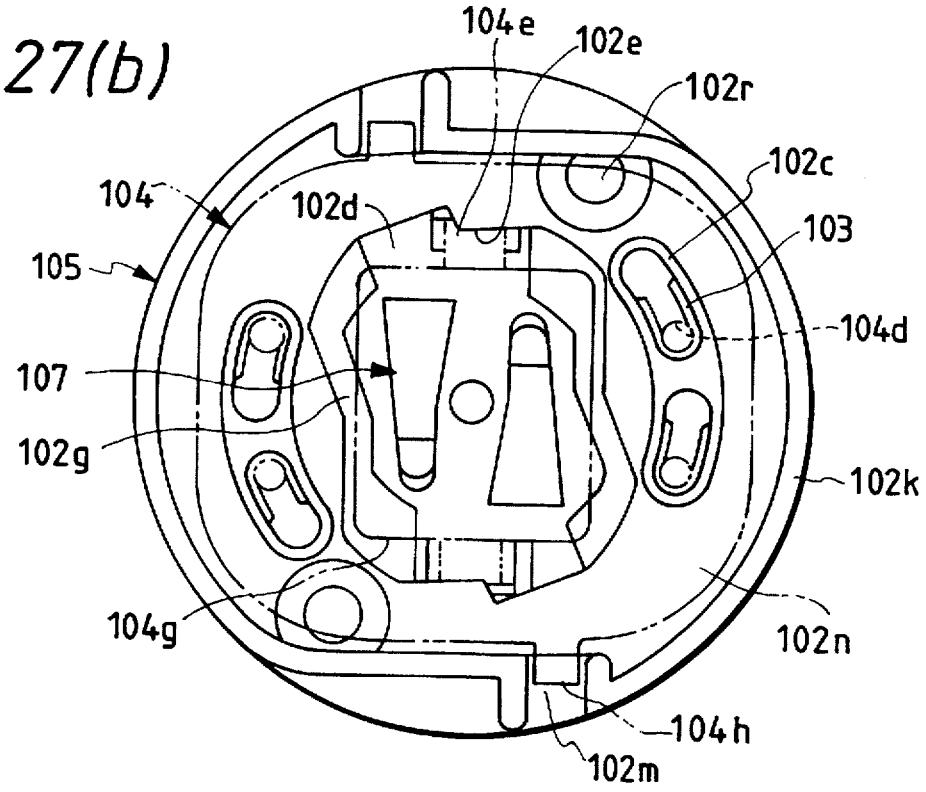

FIGS. 26 and 27 show a sixth embodiment of the single end lamp socket of the invention. The embodiment is different from the fifth embodiment in that the positioning hole is not formed in the socket body 102 and the rotor 105 is configured in a different manner, and the other components are configured in a similar manner as those of the fifth embodiment.

The rotor 105 is made of an insulative synthetic resin, and includes the following components which are integrally formed: a rotor base 105c which is thin and formed into a substantially annular shape; a partition wall 102k which stands on the upper face of the rotor base 105c; and rotor engaging claws 105d which are projected from the lower face of the rotor base 105c and engaged with the rotor engaging grooves 102p so as to rotatably engage the rotor 105 with the socket body 102. A receiving groove 102m for avoiding collision with an identification projection 104h of the single end lamp 1 is formed in the partition wall 102k. The width d4 of the receiving groove 102m in the rotation direction of the base 104 is slightly larger than the width d3 of the identification projection 104h. Therefore, the face on the side of the front face of the socket body 102 serves as the base abutting face 102n which substantially abuts against the lower face 104c of the base 104 of the single end lamp 101.

In the single end lamp socket of the embodiment, since the single end lamp socket is configured as described above, the following effects can be attained in addition to the effects of the fifth embodiment. Since the area of the rotor base 105c can be reduced, the area of the abutting face between the rotor 105 and the socket body 102 is reduced, and the weight of the rotor 105 itself is reduced. During rotation of the rotor 105, therefore, the friction resistance produced between the rotor 105 and the socket body 102 is reduced. Consequently, the rotor 105 is easily rotated so that the single end lamp 101 is easily attached. Furthermore, since the rotor 105 is easily rotated, attachment sensation can be enhanced and hence the completion of attachment can be easily recognized.

Seventh embodiment

Figure 28:
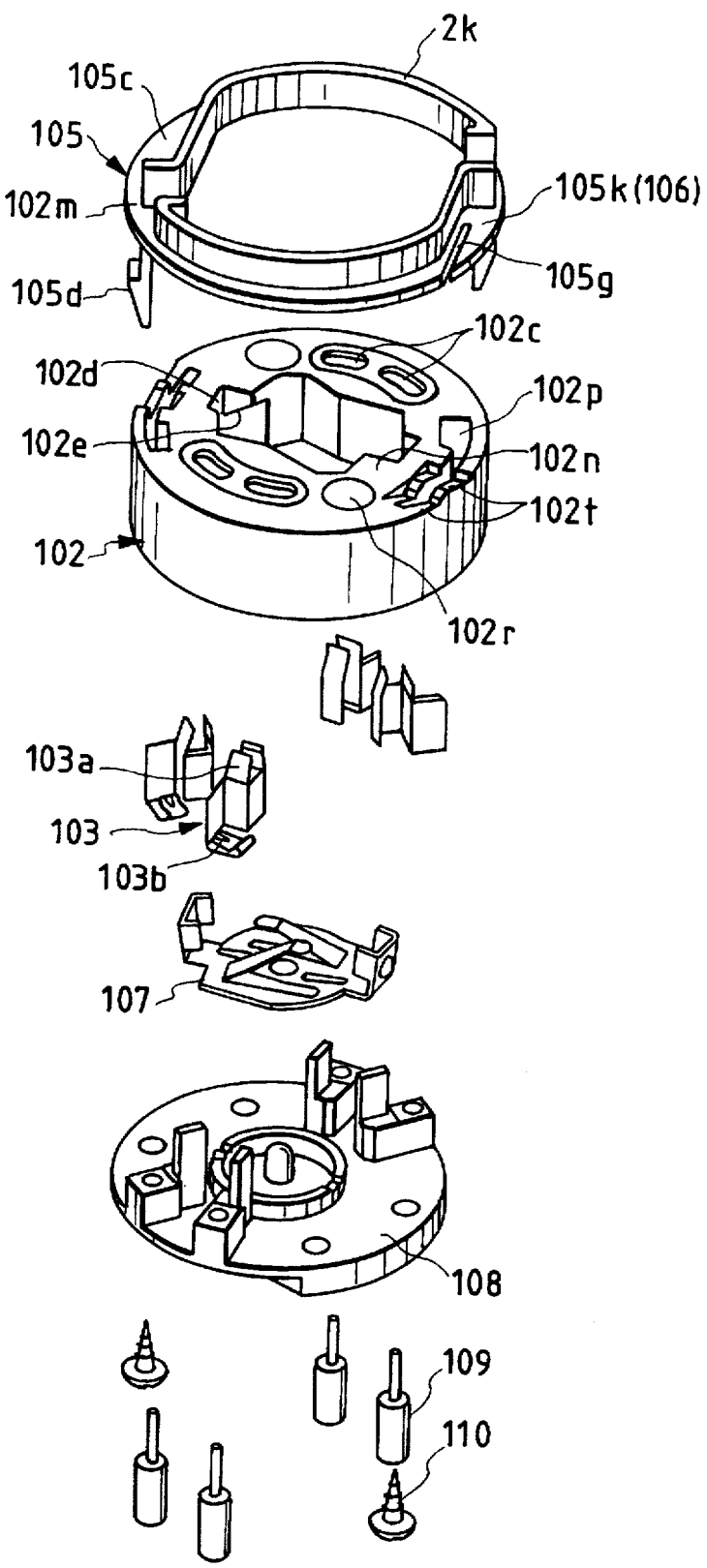
FIG. 28 is an exploded perspective view showing a seventh embodiment of the single end lamp socket of the invention.
Figure 29A:
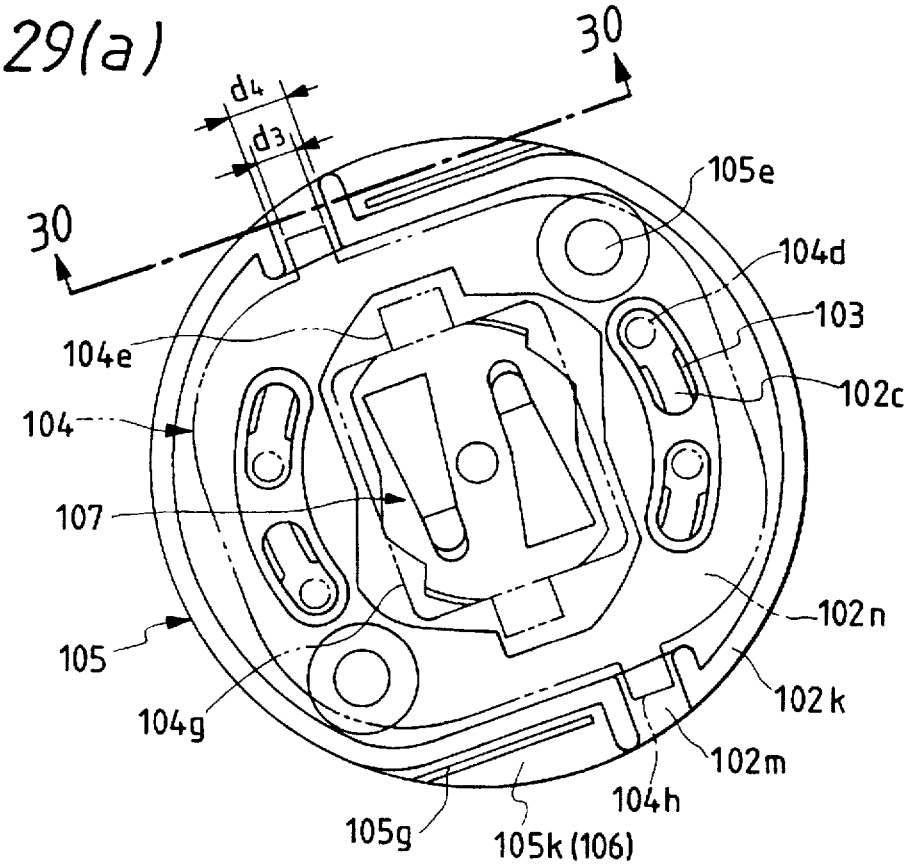
FIGS. 29(*a*) and 29(*b*) show steps of attaching a lamp in the embodiment, FIG. 29(*a*) is a plan view showing an insertion state, and FIG. 29(*b*) is a plan view showing an attachment completion state.
Figure 29B:
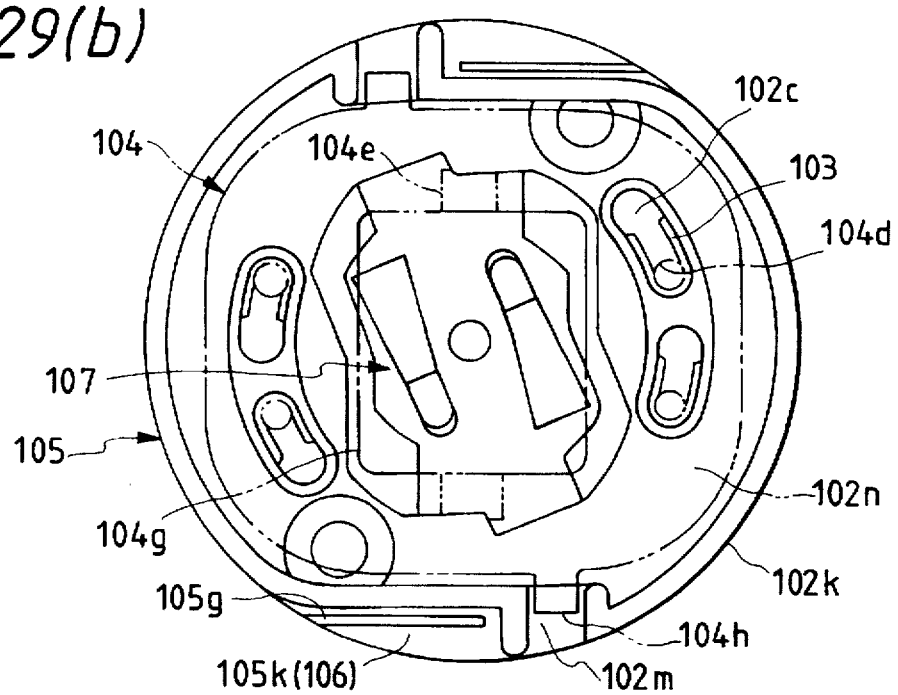
Figure 30:
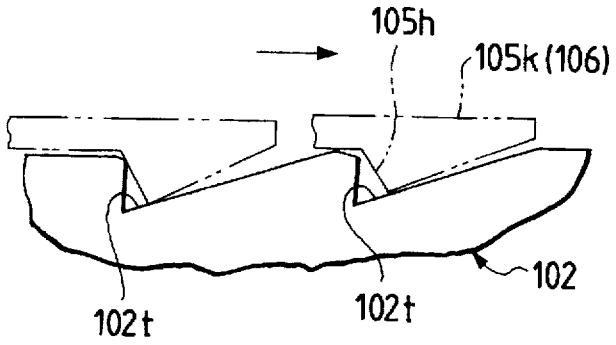
FIG. 30 is a section view taken along the line B—B in the embodiment.

FIGS. 28 to 30 show a seventh embodiment of the single end lamp socket of the invention. The embodiment is different from the sixth embodiment in that attachment sensation generating means 106 is disposed on the face where the socket body 102 abuts against the rotor 105, and that the lamp holding spring 107 is not provided with the protrusions 107a for generating attachment sensation and is housed in the socket body 102 so as not to be rotated during the operation of attaching the single end lamp 1. The other components are configured in a similar manner as those of the sixth embodiment.

The attachment sensation generating means 106 is configured by: a sensation generating spring 105k which is formed by forming a notch 105g outside the partition wall 102k of the rotor 105, and a protrusion 105h on the lower face; and sensation generating grooves 102t which are formed on the front face of the socket body 102 and at rotation starting and terminating positions of the portion which is caused to oppose the protrusion 105h by rotation of the base 104. When the rotor 105 is rotated as a result of rotation of the base 104, the protrusion 105h of the partition wall 102k is moved from the sensation generating groove 102t at the rotation starting position so as to override the side wall of the sensation generating groove 102t, and then engaged with the sensation generating groove 102t at the rotation terminating position, thereby generating attachment sensation.

In the single end lamp socket of the embodiment, since the single end lamp socket is configured as described above, the following effects can be attained in addition to the effects of the sixth embodiment. There is no difference in surface hardness between the protrusion 105h disposed on the rotor 105 constituting the attachment sensation generating means 106, and the sensation generating grooves 102t disposed on the socket body 102, and attachment sensation is generated by friction between the resins of the protrusion 105h and the sensation generating grooves 102t which resins are not different in surface hardness from each other. Consequently, there is little likelihood of differential wear in either of the protrusion 105h and the sensation generating grooves 102t. Even when operations of attaching and detaching the single end lamp 1 are repeated, therefore, a sudden reduction of attachment sensation (clicking sensation) is hardly produced, resulting in that the clicking sensation is excellent in persistency and stability.

In the embodiments described above, the contacts 103 which are conductor terminals of the socket and with which the lamp pins 104d make contact cramp laterally the lamp pins 104d. The invention is not restricted to this. Alternatively, the invention may be applied to a socket of the butt type in which contact abut against the tip ends of lamp pins so as to attain the electrical connection.

Eighth embodiment

Figure 31:
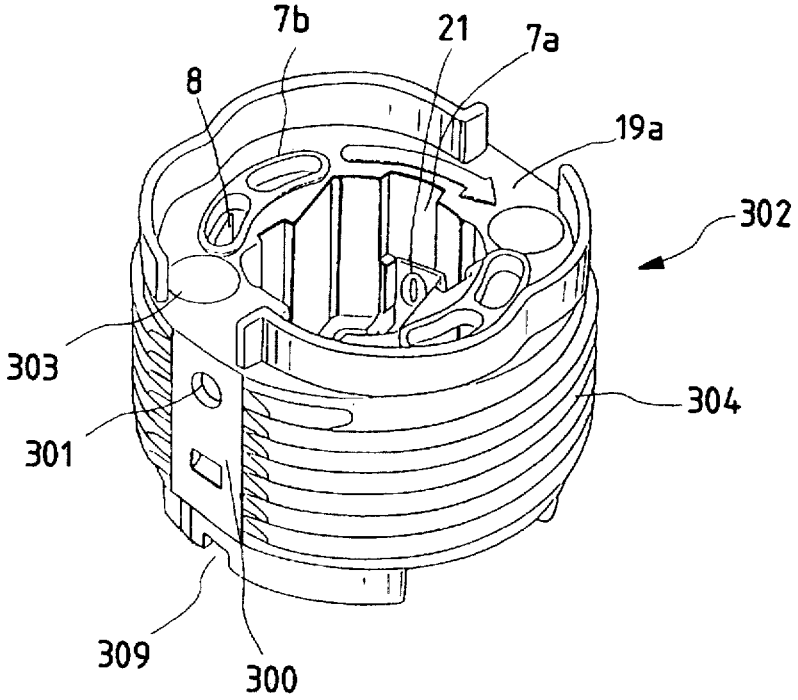
FIG. 31 is a perspective view showing the main portions of an eighth embodiment of the invention.
Figure 32:
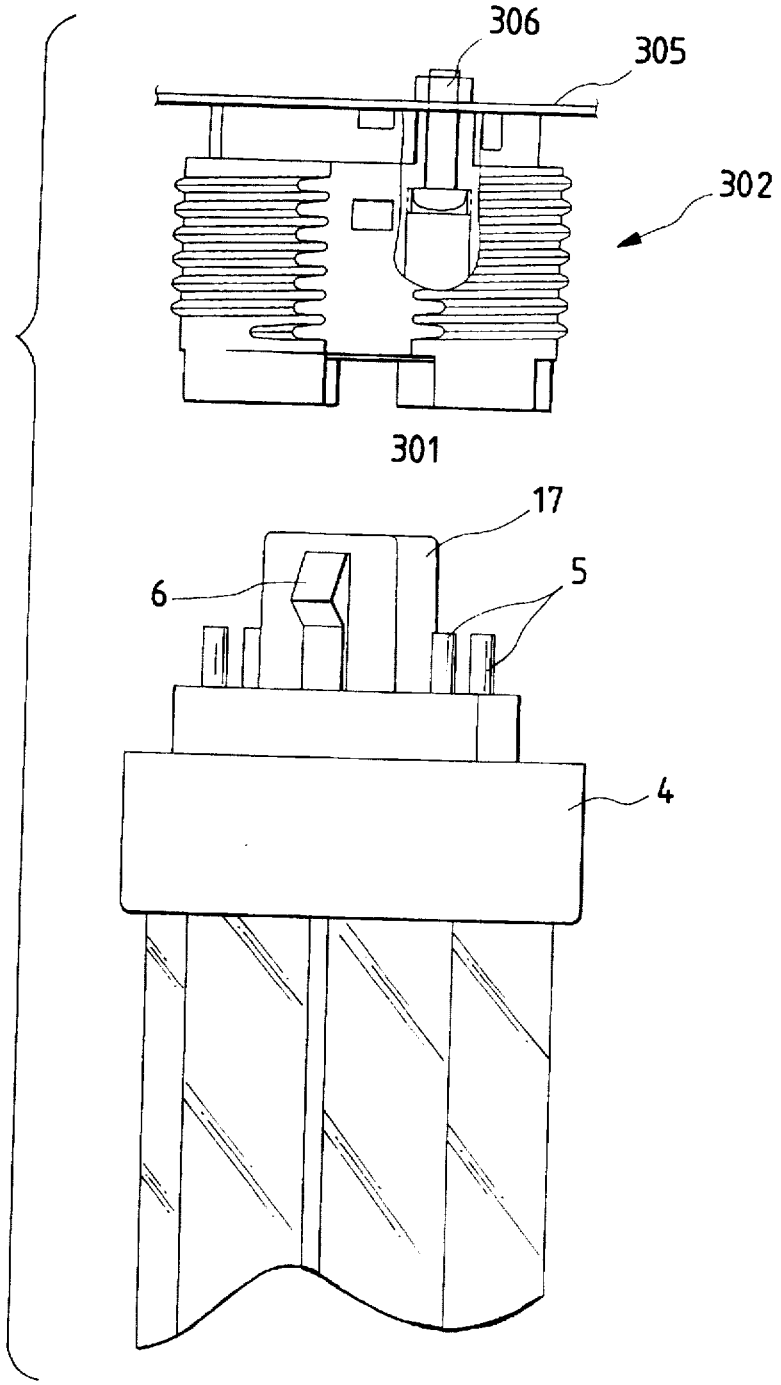
FIG. 32 is a sectional view for mounting the lamp socket shown in FIG. 31 to a celling with downward directing a recess.
Figure 33:
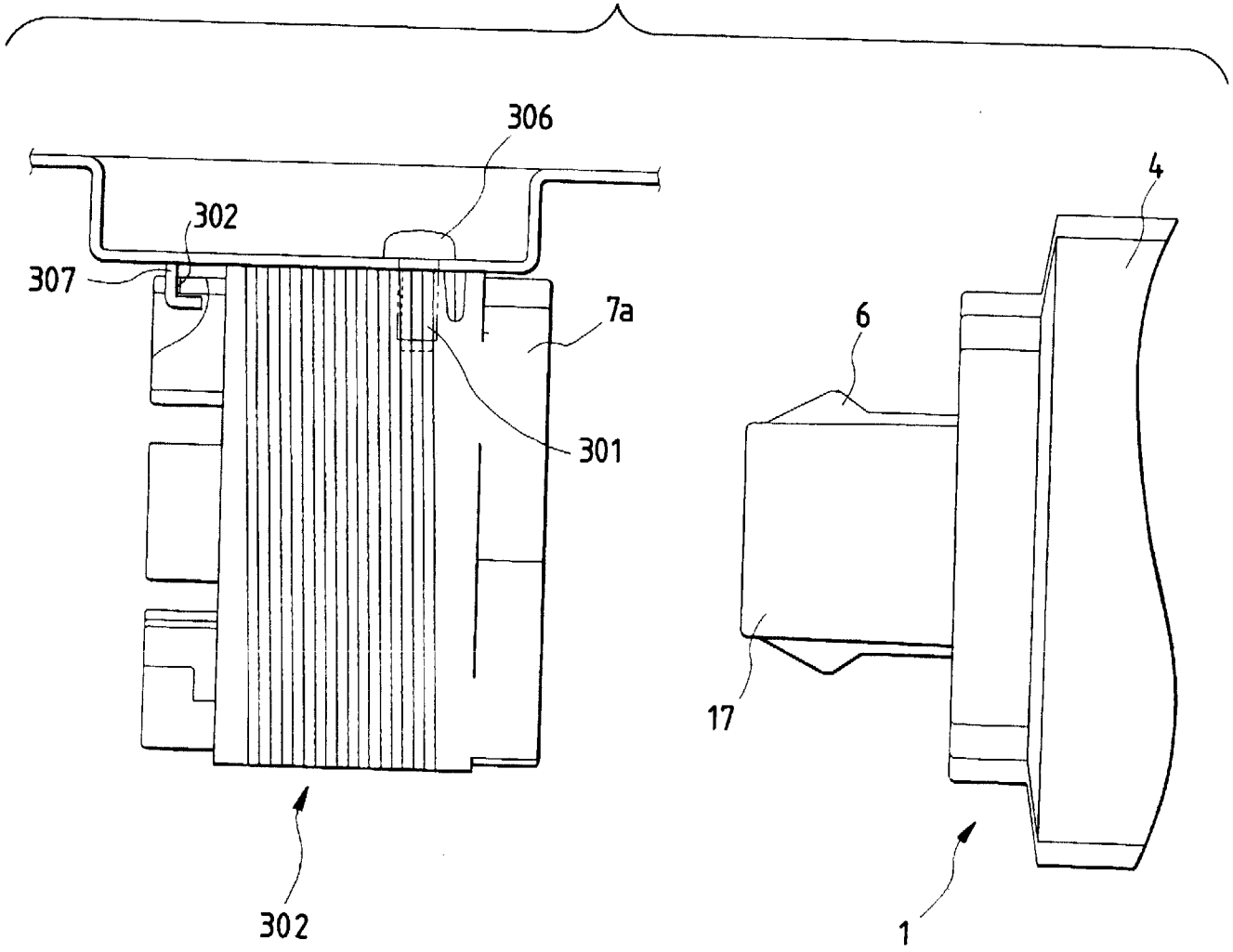
FIG. 33 is a sectional view for mounting the lamp socket shown in FIG. 31 to the celling with directing a recess in parallel with he celling.
Figure 34:
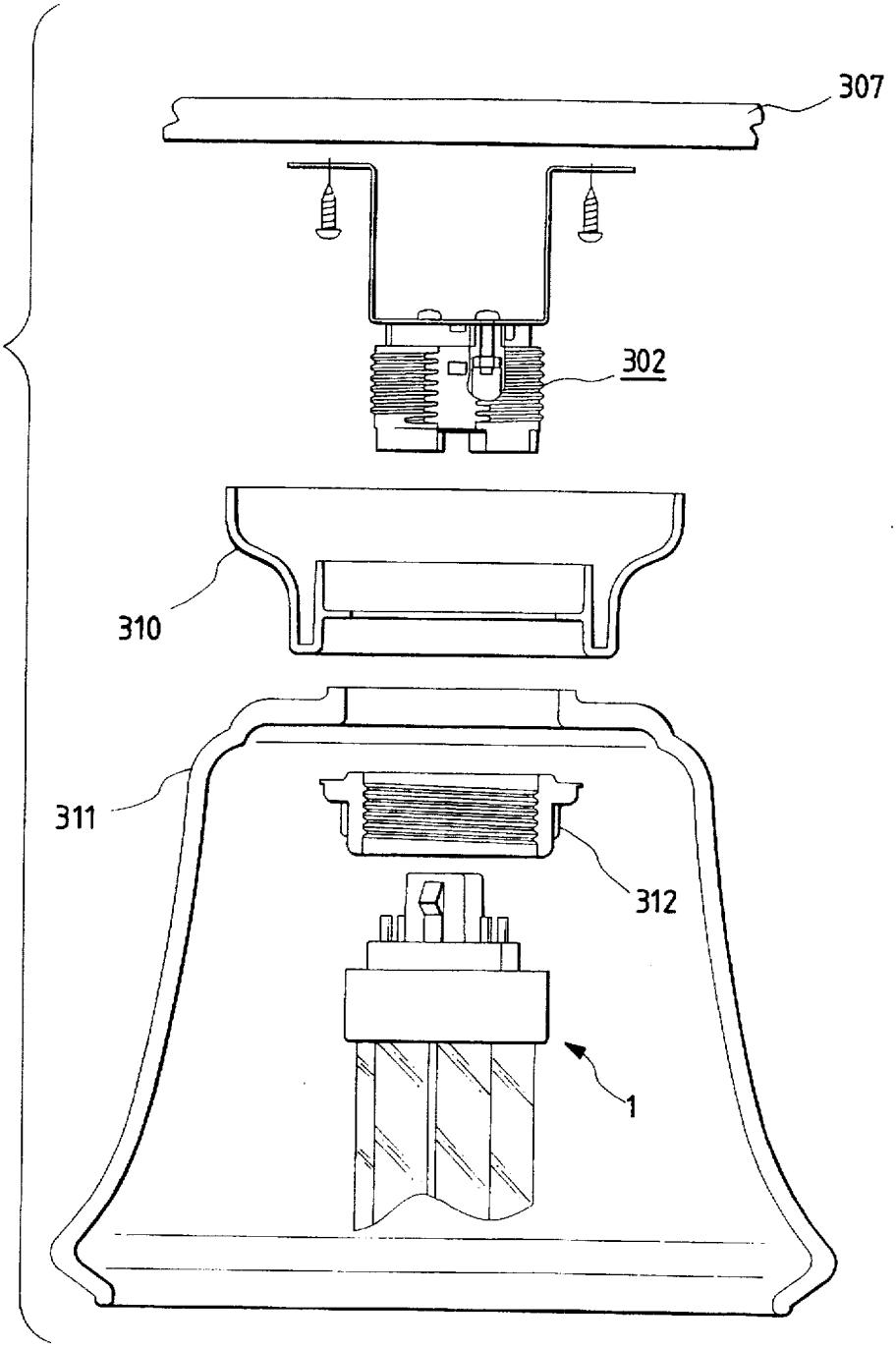
FIG. 34 is an exploded view of lamp device use of the lamp socket of the eighth embodiment of the present invention.

FIG. 31 shows an eighth embodiment of the lighting device of the invention. As shown in FIG. 31, the embodiment is different from the first embodiment in that a threaded portion 304 is formed on the outer face of the lamp socket 302, and that at least one flat portion 300 is formed on the outer face and a tapped hole 301 and a rib receiver 302 which are used for fixing the lamp socket to a wall or the like are formed in the flat portion. When the lamp socket 302 is to be directly attached to a ceiling 305 or the like with downward directing the recess 307a, as shown in FIG. 32, the lamp socket is usually fixed by screwing screws 306 or the like into holes 303. When the lamp socket is to be attached to a ceiling with directing the recess 307a in parallel with the ceiling, as shown in FIG. 33, a screw 306 or the like is screwed from the ceiling into the hole 301, and a rib or the like is inserted into the hole 309, thereby disabling the lamp socket from being rotated about the hole 301.

When the single end lamp 1 is to be used for room lamp located in the house, shade 310 and 311 are fixed to the lamp socket 302 by screwing the screw lamp holder 312 to thread portion 304.

Since the lighting device is configured as described above, according to the invention, even a single end lamp which has a projection projected from the bottom of a base of the lamp in the same direction as lamp pins can be rotatively engaged by inserting the lamp into a single end lamp socket and twisting the lamp. Therefore, it is possible to realize holding which is hardly affected by an external force.

According to the invention, when an improper single end lamp socket is used, the erroneous attachment prevention rib overrides the protection wall so that the lamp cannot be attached. Consequently, a single end lamp which does not match a lighting circuit, etc. incorporated in the lighting device is inhibited from being attached, thereby preventing erroneous attachment from occurring.

According to the invention, even a single end lamp which has a projection projected from the bottom of a base of the lamp in the same direction as lamp pins and in which the lamp pins are disposed in such a manner that two lamp pins are respectively positioned on both sides of the projection can be rotatively engaged by inserting the lamp into a single end lamp socket and twisting the lamp.

According to the invention, when the rotation angle of the single end lamp is set to be 17° or more, the single end lamp can be surely held by the single end lamp socket, and, when the rotation angle is set to be 23° or less, an insulation wall of 0.8 mm or more can be formed between adjacent lamp pins of different polarities and hence the safety is ensured.

According to the invention, when the single end lamp is rotated, the engaging projection formed on the projection of the base is fixed with being engaged with the engaging portion formed on the side wall of the recess of the socket body, and hence the single end lamp can be easily attached. Furthermore, a strong resistance can be exerted against a pulling force acting on to the single end lamp, and, even when an impact, vibrations, or the like are applied to the lighting device, the single end lamp hardly slips off by accident.

According to the invention, the single end lamp is urged toward the bulb so that the single end lamp is surely held, and hence the single end lamp is caused more hardly to slip off by an impact, vibrations, or the like.

According to the invention, even when the portion of the engaging projection of the single end lamp which abuts against the engaging portion of the engaging projection has an inclined face forming an angle with respect to the center axis of the projection, the lamp can be surely engaged with the single end lamp socket. Since the single end lamp is held under the state where the inclined face of the single end lamp makes surface contact with the abutting face of the single end lamp socket, inclination and rattling of the single end lamp in the direction along which the engaging projection is disposed can be reduced in degree. Even when the single end lamp is horizontally attached so that the side on which the engaging projection is disposed is vertically directed, the sag of the lamp due to its weight can be reduced in degree.

According to the invention, the elasticity range of the conductor plate is not impaired by movement of the conductor plate which may be caused by pitch variation of the lamp pin, rattling of the conductor plates, or the like. Therefore, the single end lamp can be surely attached to the socket.

Since the single end lamp socket is configured as described above, according to the invention, the width of the identification projection of the single end lamp can be made substantially equal to that of the receiving groove of the socket body or set so as to have the minimal value, and therefore a large number of combinations of the identification projection and the receiving groove which prevent erroneous attachment can be produced. Even when ratings of the lamp are increased in number so that the kinds of the single end lamp are increased, therefore, a countermeasure for prevention of erroneous attachment can be easily taken. When the lamp is to be inserted, since the opening of the rotor has a substantially same shape as the projection, the positioning of the base in the rotation direction can be easily done, thereby facilitating the attachment of the lamp. With respect to lamps of different ratings, since prevention of erroneous attachment can be coped with only by replacing the rotor with another one while commonly using the socket body, the production cost can be lowered.

According to the invention, when no lamp is attached, the base abutting face exists in front of the contacts and hence the insulation properties can be easily ensured.

According to the invention, the area of the abutting face between the rotor and the socket body is reduced, and the weight of the rotor itself is reduced. During rotation of the rotor, therefore, the friction resistance produced between the rotor and the socket body is reduced. Consequently, the rotor is easily rotated so that the single end lamp is easily attached. Furthermore, since the rotor is easily rotated, attachment sensation can be enhanced and hence the completion of attachment can be easily recognized.

According to the invention, the attachment sensation generating means is disposed between the rotor and the socket body, and attachment sensation is generated by friction between the resins of the rotor and the socket body which are not different in surface hardness from each other. Consequently, there is little likelihood of differential wear in either of the members. Even when operations of attaching and detaching the single end lamp are repeated, therefore, a sudden reduction of attachment sensation (clicking sensation) is hardly produced, resulting in that the clicking sensation is excellent in persistency and stability.

What is claimed is:

1. A single end lamp and a single end lamp socket assembly comprising:

a single end lamp including:

a base;

a bulb projected from a first surface of said base;

a lamp pin projected from a second face of said base in a direction opposite to said bulb;

a projection projected from said second face of said base at substantially a center portion of said base; and a lock engaging portion laterally projected from a side face of said projection;

a single end lamp socket including:

a socket body having a recess portion shaped to receive said projection of said single end lamp so that said projection is rotatable by a predetermined rotation angle, said recess portion opening to a lamp attaching face of said socket body;

an arcuate lamp pin insertion hole formed in a circumferential region of said lamp attaching face outside said recess portion and concentric with said recess portion, said arcuate lamp pin insertion hole being shaped to receive said lamp pin;

a conductor plate disposed in said lamp pin insertion hole for elastically contacting said lamp pin; and an engaging portion disposed on a side wall of said recess portion, said engaging portion being disposed to abut against said lock engaging portion to retain said single end lamp in said single end lamp socket when said single end lamp is rotated by said predetermined rotation angle.

2. A single end lamp and a single end lamp socket assembly according to claim 1, further comprising:

an identification projection disposed on a peripheral side of said second face of said base in such a manner than said identification projection is projected in a direction substantially parallel to said projection; and an identification wall disposed in an outer periphery of an attaching face of said socket body, said identification wall having a receiving groove into which said identification projection is to be inserted.

3. A single end lamp and a single end lamp socket assembly according to claim 1, further comprising:

an identification projection disposed on a peripheral side of said second face of said base in such a manner than said identification projection is projected in a direction substantially parallel to said projection; and a rotor rotatably disposed with respect to said socket body and disposed on a side of said socket body to which said single end lamp is to be attached, said rotor having an identification wall disposed in an outer periphery of said rotor, said identification wall having a receiving groove into which said identification projection is to be inserted.

4. A single end lamp and a single end lamp socket assembly according to claim 1, further comprising:

a lamp holding spring for urging said single end lamp in a direction from said base to said bulb when said single end lamp is attached to said single end lamp socket.

5. A single end lamp and a single end lamp socket assembly according to claim 1, wherein said lock engaging portion has an inclined face which extends at a predetermined angle with respect to a center axis of said projection so that a projecting amount of said inclined surface from said projection is increased moving in a direction from said second face of said base toward a tip end of said projection, and wherein said engaging portion comprises an abutting face which has an inclination corresponding to said inclined face, said abutting face of said engaging portion abutting against said inclined face of said lock engaging portion.

6. A single end lamp and a single end lamp socket assembly as claimed in claim 3, further comprising:

means for generating attachment sensation indicative of completion of attachment of said single end lamp when attachment of said single end lamp is completed, said means for generating attachment sensation being disposed between said socket body and said rotor.

7. A single end lamp and a single end lamp socket assembly as claimed in claim 1, wherein said predetermined rotation angle is within a range from about 17° to about 23°.

8. A single end lamp socket comprising:

a socket body including:

a housing recess provided on a center portion of said socket body, an engaging portion disposed on said side wall of said housing recess, and a plurality of arcuate lamp pin insertion holes formed outside said housing recess adjacent an outer peripheral portion of said socket body, said lamp pin insertion holes each being concentric with said housing recess;

a lamp holding spring disposed in said housing recess;

a plurality of contacts communicating with said plurality of said arcuate lamp pin insertion holes, respectively, said contacts being mounted in said socket body; and an identification wall formed on the outer peripheral portion of said socket body in such a manner that said identification wall is located farther from the center portion of said socket body than said plurality of arcuate lamp pin insertion holes, said identification wall having a recess portion.

9. A single end lamp socket as claimed in claim 8, wherein:

said engaging portion has an inclined face which extends at a predetermined angle with respect to a center axis of said socket body.

10. A single end lamp socket as claimed in claim 8, wherein an outer surface of said socket body has a threaded portion and at least one planar surface.

11. A single end lamp socket comprising:

a socket body including:

a housing recess provided on a center portion of said socket body, an engaging portion disposed on said side wall of said housing recess, and a plurality of elongated lamp pin insertion holes formed outside said housing recess adjacent an outer peripheral portion of said socket body;

a lamp holding spring disposed in said housing recess;

a plurality of contacts communicating with said plurality of said elongated lamp pin insertion holes, respectively, said contacts being mounted in said socket body;

a rotor rotatably supported on said socket body, said rotor having an identification wall disposed in an outer periphery of said rotor, said identification wall having a groove, and said identification wall being located farther from the center portion of said socket body than said plurality of elongated lamp pin insertion holes.

* * * * *